US006527406B1

(12) United States Patent
Slesinger et al.

(10) Patent No.: US 6,527,406 B1
(45) **Date of Patent: *Mar. 4, 2003**

(54) INTEGRALLY POWERED MODULAR FURNITURE

(75) Inventors: Bruce M. Slesinger, San Francisco, CA (US); Thomas L. Collom, San Francisco, CA (US); Frank Neidhardt, Palo Alto, CA (US)

(73) Assignee: Powerwall, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/155,638

(22) PCT Filed: Apr. 11, 1997

(86) PCT No.: PCT/US97/06074

§ 371 (c)(1),
(2), (4) Date: Oct. 1, 1998

(87) PCT Pub. No.: WO97/38610

PCT Pub. Date: Oct. 23, 1997

Related U.S. Application Data

(63) Continuation-in-part of application No. 08/631,462, filed on Apr. 12, 1996, now Pat. No. 5,695,261.
(60) Provisional application No. 60/037,714, filed on Feb. 12, 1997.

(51) Int. Cl.[7] ..... A47B 96/00
(52) U.S. Cl. ..... 362/127; 362/132; 362/249; 312/223.6
(58) Field of Search ..... 362/127, 125, 362/132, 249, 395; 312/223.3, 223.6; 52/36; 108/50.02; 174/48

(56) References Cited

U.S. PATENT DOCUMENTS

| | | | | | |
|---|---|---|---|---|---|
| 4,489,995 | A | * | 12/1984 | Barr | 312/236 |
| 4,549,777 | A | * | 10/1985 | Schindler | 312/198 |
| 4,972,339 | A | | 11/1990 | Gabrius | 362/366 |
| 4,973,796 | A | * | 11/1990 | Dougherty et al. | 174/48 |
| 5,022,720 | A | * | 6/1991 | Fevig et al. | 312/223.5 |
| 5,034,861 | A | | 7/1991 | Sklenak et al. | 362/92 |
| 5,259,774 | A | | 11/1993 | Gabrius | 439/110 |
| 5,334,037 | A | | 8/1994 | Gabrius et al. | 439/118 |
| 5,336,100 | A | | 8/1994 | Gabrius et al. | 439/115 |
| D350,834 | S | | 9/1994 | Roos et al. | D26/134 |
| D355,501 | S | | 2/1995 | Roos et al. | D26/63 |
| 5,425,648 | A | * | 6/1995 | Farham | 439/116 |
| D362,656 | S | | 9/1995 | Roos et al. | D13/134 |
| 5,564,815 | A | | 10/1996 | Littman et al. | 362/147 |
| D376,026 | S | | 11/1996 | Wachter | D26/63 |
| 5,695,261 | A | * | 12/1997 | Slesinger et al. | 312/223.6 |
| D394,241 | S | | 5/1998 | Wachter et al. | D13/110 |
| 5,788,518 | A | | 8/1998 | Wachter et al. | 439/121 |

FOREIGN PATENT DOCUMENTS

| | | | |
|---|---|---|---|
| DE | 38 09 859 C1 | 3/1989 | A47F/11/10 |
| FR | 2 731 885 A1 | 9/1996 | A47B/47/00 |
| GB | 2 272 279 A | 5/1994 | F21V/33/00 |

* cited by examiner

*Primary Examiner*—Sandra O'Shea
*Assistant Examiner*—Ronald E. DelGizzi
(74) *Attorney, Agent, or Firm*—Fish & Neave

(57) ABSTRACT

A modular furniture system is provided having vertical members with internal conductors. The conductors are coupled to a source of low voltage electrical power such that adjacent vertical members are of differing electrical polarity. Support members for use in the modular furniture system are designed to make electrical contact with the internal conductors when engaged in a vertical member. An electrical device, such as a light fixture, may be coupled between a pair of brackets engaged in vertical members of opposite polarity, energizing the electrical device. Embodiments are provided for use in merchandising displays and office partition systems.

17 Claims, 22 Drawing Sheets

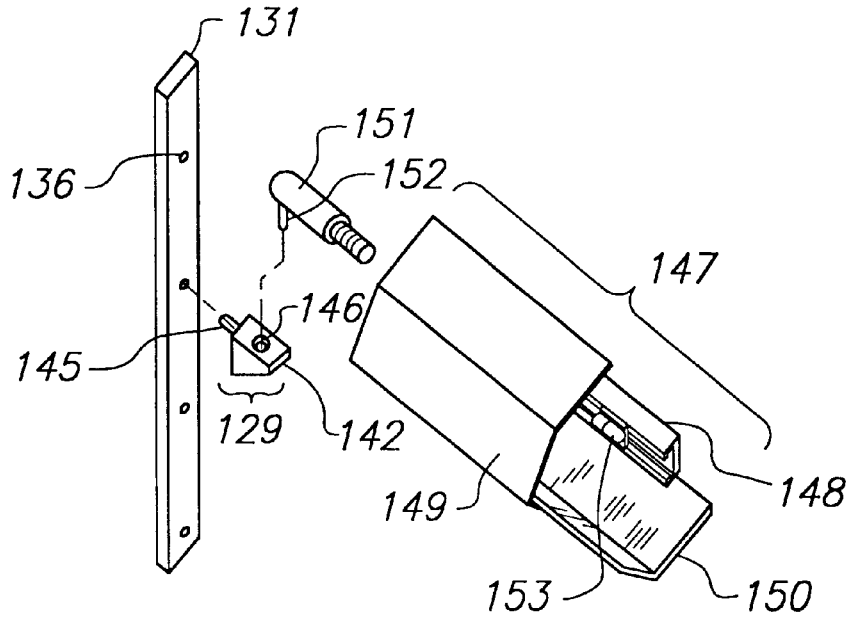
FIG. 18
FIG. 19
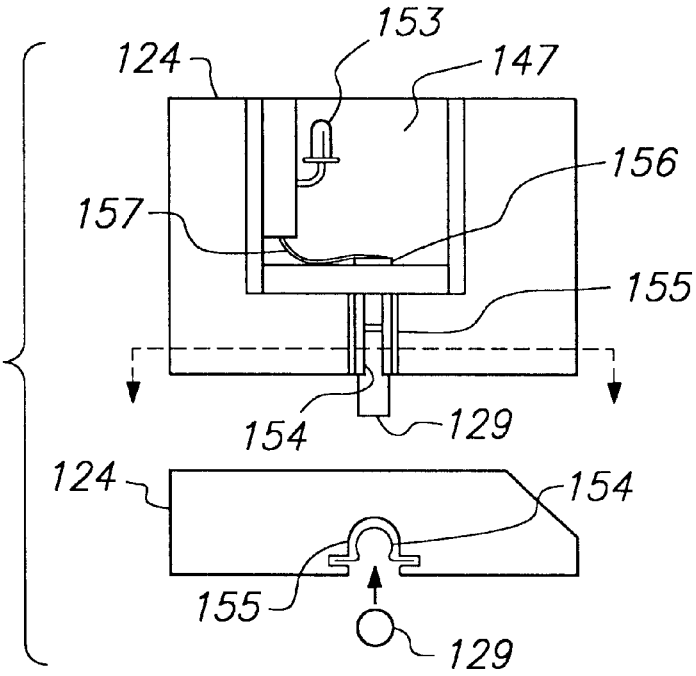

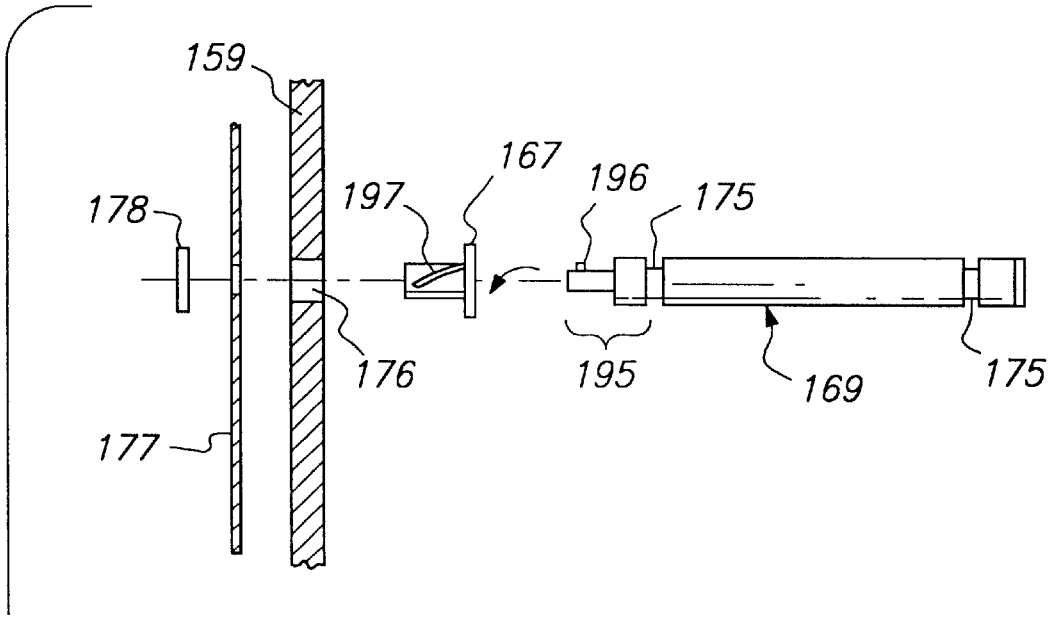
FIG. 22
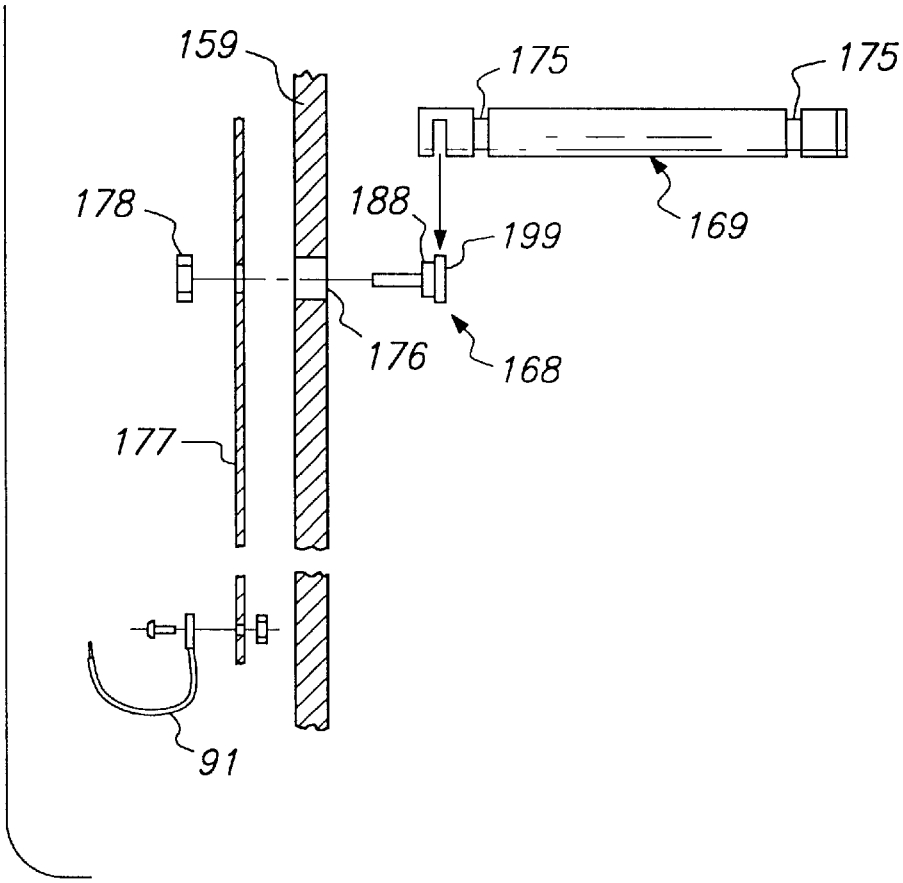

INTEGRALLY POWERED MODULAR FURNITURE

Priority is claimed from International Application PCT/US97/06074, filed Apr. 11, 1997, which claims priority from and is a continuation-in-part of U.S. patent application Ser. No. 08/631,462, filed Apr. 12, 1996, now U.S. Pat. No. 5,695,261, issued Dec. 9, 1997, and U.S. Provisional Application Ser. No. 60/037,714, filed Feb. 12, 1997.

BACKGROUND OF THE INVENTION

The present invention relates generally to electrified wall structures and particularly to wall structures including low voltage buses for powering low voltage light fixtures in a merchandising or office partitioning system.

In a retail environment it is common for merchandise to be displayed on a modular system of adjustable shelves and display racks. Typical display systems may include vertical members, often referred to as standards, which may be fixed to a wall or between the floor and ceiling. Display shelves or racks include brackets specifically designed to engage the standards at any one of a plurality of locations. Typically, this is accomplished via tongues and notches on the brackets mating with slots or holes in the face of the vertical standard. The shelves and racks may then be easily repositioned by disengaging the brackets from one location on a vertical standard and re-engaging the brackets at a different location.

Other typical display systems may include bookshelf type display cases. These types of display cases typically have a number of holes bored into opposing sides of the case. Pegs may be inserted into the holes to support shelves for displaying merchandise. Such displays may be easily rearranged by relocating the pegs to different sets of holes in the sides of the display case.

Another common display comprises a wall unit having a number of holes bored through its surface, similar to a peg board. Alternatively, the wall unit may have a number of pucks, or disks, spread out on its surface. Rods and pegs are inserted into the holes, or attached to the pucks, to support shelves, hangers, and other devices for the display of merchandise.

To attract customers it is important that a merchandise display be aesthetically pleasing so as to present the merchandise to a potential customer in a highly visible and attractive manner. In many retail establishments, the major source of lighting is wide area illumination provided by ceiling mounted light fixtures, supplemented with spot lighting for accent and highlighting of specific areas or merchandise. When non-illuminated shelving is used, shelves nearer the ceiling cast shadows which results in less than optimal lighting of merchandise on lower shelves. It is therefore desirable to provide a means of illuminating merchandise on lower shelving or racks of a display.

Prior art attempts to provide illuminated display systems have been less than satisfactory either because they are aesthetically displeasing or are cumbersome and inflexible. Early attempts at providing illuminated shelving were essentially ordinary light fixtures mounted to the underside of a display shelf. A conventional power cord was then run from the light fixture to an outlet. Preferably, the cord was strung under shelving, behind merchandise on display, or otherwise hidden from a customer's view so that it would not detract from an otherwise pleasing display. For a system of fixed shelving, or shelving with a limited range of adjustment, the power cord may be hidden from view fairly successfully. However, when using vertically adjustable shelving, the power cord would typically droop or otherwise be exposed to view.

Previous systems have attempted to alleviate some of these difficulties by providing an outlet or power source that may be moved within a limited range so that it is located adjacent to a shelf containing a light fixture. For example, U.S. Pat. No. 5,022,720 discloses a bakery display case that provides vertically adjustable shelves having a light fixture mounted on the front. A plurality of electrical outlets are slidably mounted in a channel at the rear of the display area. The outlets may be relocated vertically within a limited range so that an outlet is juxtaposed adjacent to each shelf, to help minimize power cord exposure.

Alternatively, U.S. Pat. Nos. 4,973,796 and 5,425,648, disclose vertical shelf standards including internal conductors. The conductors are housed within the standards in such a way that an ordinary shelf bracket would not contact the conductors. Specially designed couplers include spring wires or clips that contact the internal conductors when the coupler is inserted into the shelf standard. In a display unit according to either of these patents, an illuminated shelf may be inserted into and supported by a pair of shelf standards and a special electrical coupler cabled to a light fixture may be inserted into one of the shelf standards just below the shelf itself to help minimize cable exposure.

While the aforementioned patents solve the problem of providing power to shelf light fixtures, they involve the use of shelf standards and connectors that are electrically and mechanically complex and are therefore more costly to manufacture than conventional shelf standards, and are more susceptible to failure due to mechanical fatigue and wear. Furthermore, electrical connections to the internal conductors of the shelf standards are made by a separate, specially designed connector located adjacent to, but not integral with, a supporting bracket for an illuminated shelf, so the power cord is not entirely hidden from view.

In view of the foregoing, it would be desirable to provide a modular furniture and shelving system including illuminated shelving and other powered fixtures wherein electrical connections for energizing the illuminated shelves and other powered fixtures do not detract from the aesthetic appeal of the system.

It would also be desirable to provide a modular furniture and shelving system wherein the components thereof are electrically and mechanically simple in design and therefore relatively inexpensive to manufacture.

It would further be desirable to provide a modular furniture and shelving system employing low voltage to energize powered portions thereof so as to minimize the possibility of electrical shock and other electrical hazards.

In addition, it would be desirable to provide a modular furniture and shelving system in which power coupling between a vertical member and a powered fixture is integral to the fixture support brackets.

SUMMARY OF THE INVENTION

It is therefore an object of the invention to provide a modular furniture and shelving system including illuminated shelving and other powered fixtures wherein electrical connections for energizing the illuminated shelves and other powered fixtures do not detract from the aesthetic appeal of the system.

It is also an object of the invention to provide a modular furniture and shelving system wherein the components thereof are electrically and mechanically simple in design and therefore relatively inexpensive to manufacture.

It is a further object of the invention to provide a modular furniture and shelving system employing low voltage to energize powered portions thereof so as to minimize the possibility of electrical shock and other electrical hazards.

It is an additional object of the invention to provide a modular furniture and shelving system in which power coupling between a vertical member and a powered fixture is integral to the fixture supports.

These and other objects and advantages of the present invention are realized by providing a modular assembly including vertical members having an internal electrical conductor or bus. The conductors are coupled to a source of low voltage electrical power so that adjacent conductors are of opposite polarity. Shelves and light fixtures according to the invention use supports covered with an electrical insulator except at the end designed for mating with the vertical member. A light fixture or other electrical device is coupled between a pair of supports so that when the supports are inserted into a pair of adjacent vertical members the supports contact the internal conductors, thus providing power to the light fixture.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which:

FIGS. 18 and 19 show alternative means of providing power to an adjustable shelf in the bookcase of FIG. 16;

FIG. 22 shows more detailed views of the peg and puck wall system of FIG. 21.

DETAILED DESCRIPTION

Figure 1:
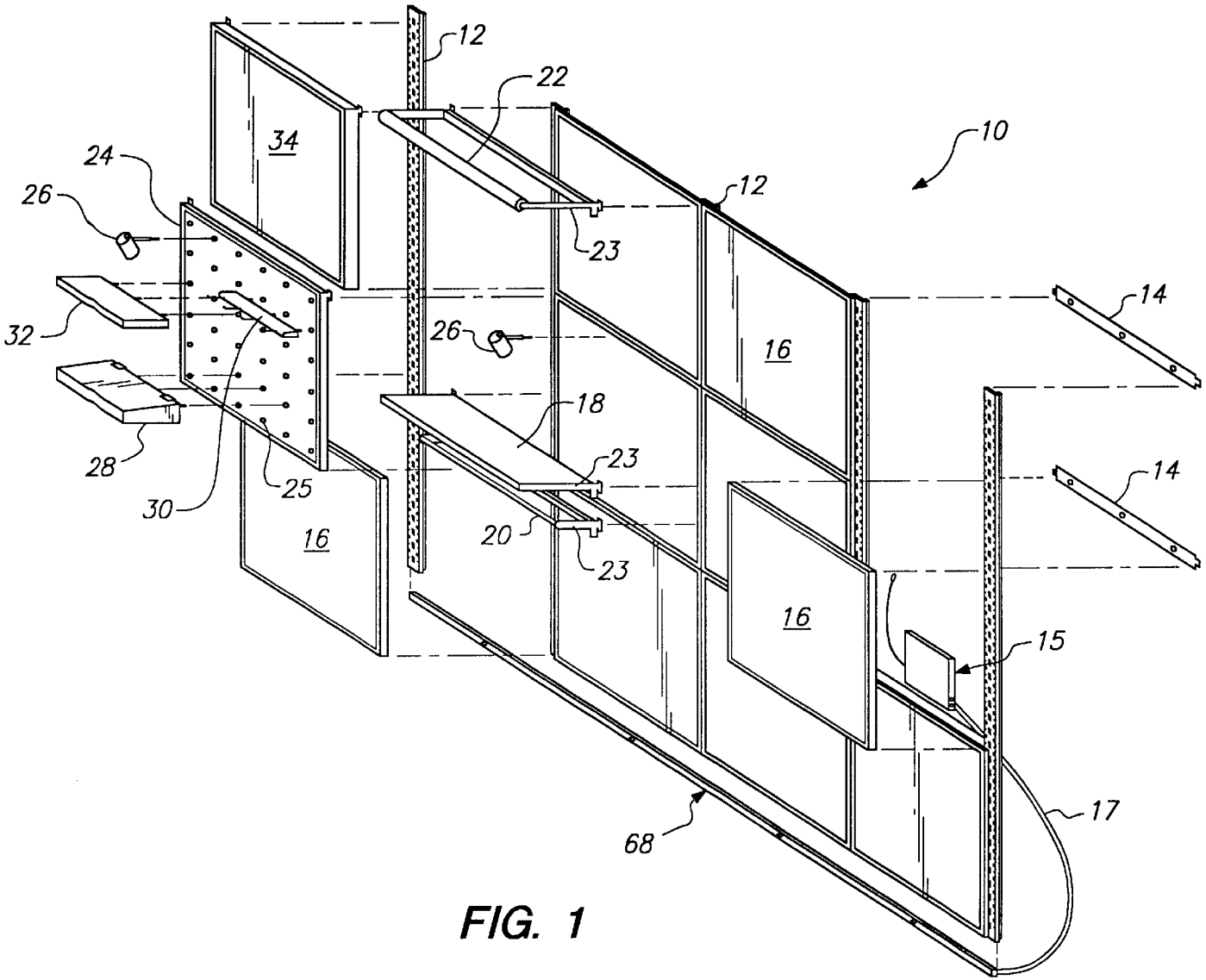
FIG. 1 shows an exploded perspective view of an illustrative merchandise display constructed in accordance with the principles of the present invention.

Referring first to FIG. 1, modular furniture system 10 includes a grid like framework formed by vertical members 12 and horizontal members 14. Vertical members 12 are typically affixed to a wall or to sills 68 attached to the floor, and possibly to the ceiling. A low voltage power source, such as transformer 15, is coupled to the vertical members by wires 17 and sill 68 to provide a electrical power to the various components of modular furniture system 10.

Panels 16 are removably mounted to vertical members 12 to substantially conceal the supporting framework and supporting wall as well as to provide an aesthetically pleasing background for the merchandise to be displayed. Modular furniture such as lighted shelf 18, clothes rack 20, and light fixture 22 include brackets 23 which are designed to removably engage vertical members 12, allowing the furniture pieces to be positioned as desired. Similarly, smaller items such as spot-light 26, hook 30, and shelf 32 may be mounted in sockets located in horizontal members 14 and panels 24.

Additionally, powered panel 24 and light box 34 may be removably mounted to vertical members 12 to replace one or more of panels 16. Powered panel 24, which generally resembles a portion of peg-board, provides a plurality of sockets 25 for supporting and powering smaller modular pieces such as spot-light 26 and illuminated case 28. Non-electrical pieces, such as hooks 30 and shelf 32, may also be used with powered panel 24. Furniture pieces such as spot-light 26, hooks 30, and shelf 32 may also be used with horizontal members 14. Light box 34 includes a translucent face and an internal light source, and may be used for displaying posters and advertising displays.

Figure 2:
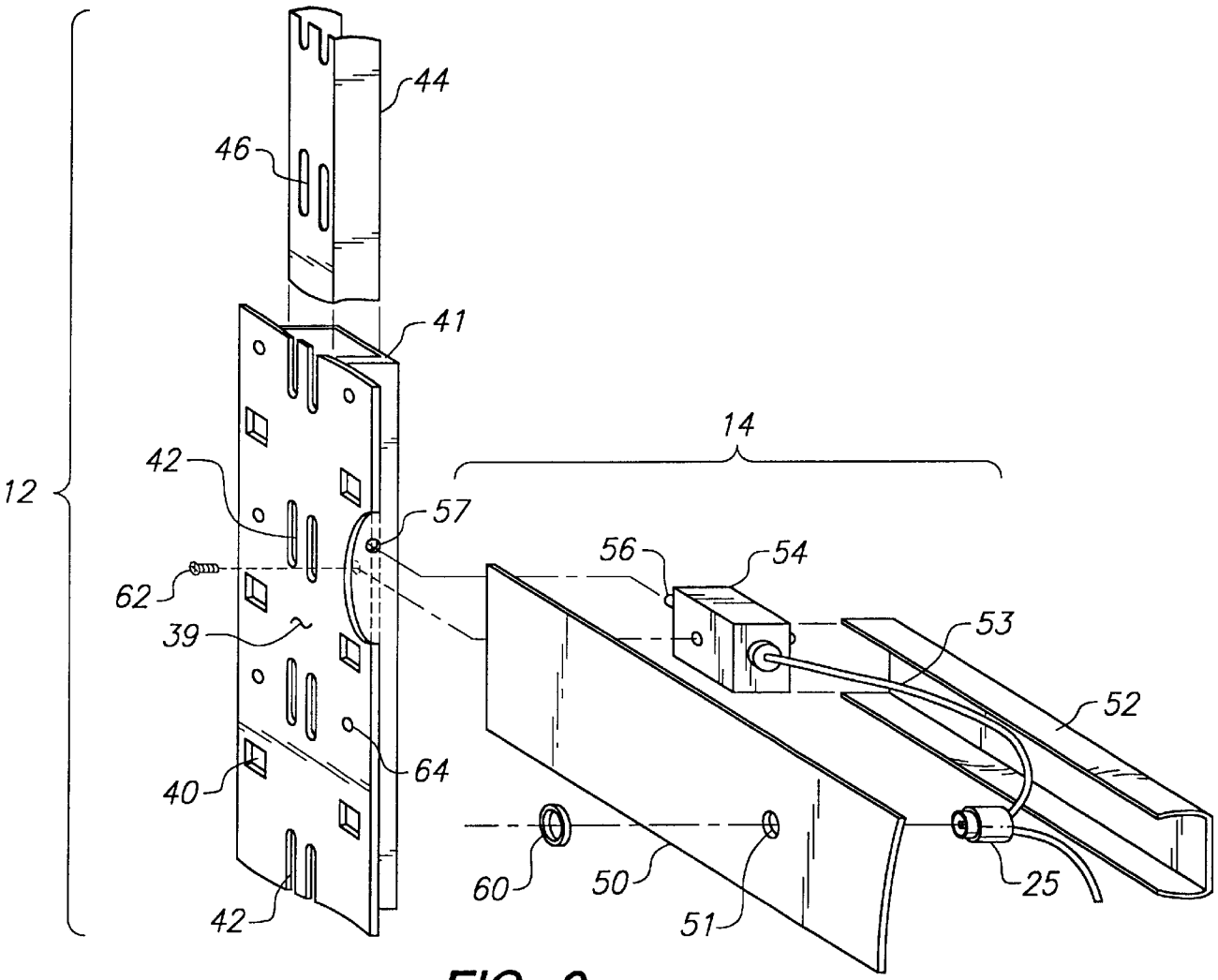
FIG. 2 is a detailed view depicting an exemplary method of electrically and mechanically coupling a horizontal member to a vertical shelf standard.

Referring now to FIG. 2, the design of an illustrative embodiment of vertical member 12 is described. Vertical member 12 generally comprises elongated outer member 39 and cap 41 which together form a box channel. Preferably, outer member 39 and cap 41 are manufactured from aluminum, steel, or other suitable material, and may be formed using either a machining or extruding process. Outer member 39 and cap 41 preferably have a powder or plastic-dipped coating to electrically insulate vertical member 12 from other components of the modular furniture system. Alternatively, outer member 39 may be formed from an extruded plastic material, in which case a insulative coating is not required. Slot shaped openings 42 are provided in outer member 39 to accept a shank portion of a support bracket for a modular furniture piece. Further openings, such as rectangular holes 40 are designed to mate with corresponding protrusions on a rear portion of modular wall panels 16, as shown in FIG. 1.

Conductor 44 is disposed immediately behind outer member 39, and is preferably composed of a conductive material, such as brass or copper, folded or extruded to have a U-shaped cross section. Openings 46 are then punched or machined into conductor 44 so that when conductor 44 is juxtaposed behind outer member 39, openings 46 are aligned with slots 42. The openings in outer member 39 and conductor 44 provide a means for a shank portion of bracket 23 to mechanically and electrically engage vertical member 12 as shown in FIG. 3C, discussed hereinbelow. Alternatively, only the outer surface of outer member 39 is powder or plastic-dip coated and the inner surface is left bare, or is nickel plated, to act as a conductor and conductor 44 may be omitted.

Figure 3B:
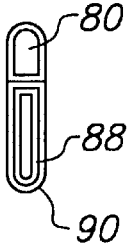
FIGS. 3A through 3C show detailed views of the construction of a support bracket in accordance with the principles of the present invention.
Figure 3A:
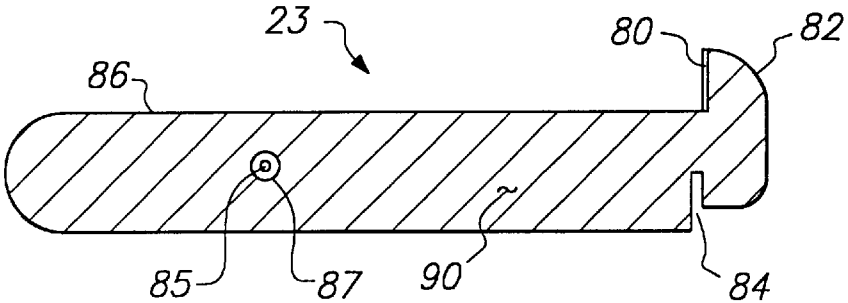
Figure 3C:
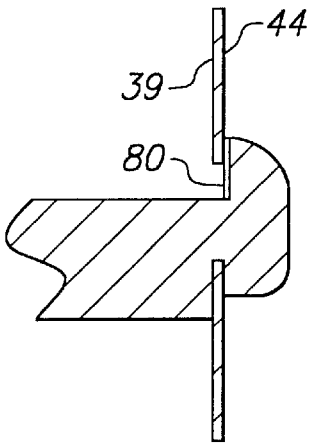

Referring now to FIGS. 3A and 3B, side and front elevations, respectively, of an illustrative embodiment of bracket 23 are shown. Bracket 23 is typically a flat, elongated portion of steel or aluminum having a shape similar to that shown in FIG. 3A. Bracket 23 includes cantilever portion 86 and a shank portion generally indicated by reference character 82. Shank portion 82 includes vertical face 80 and notch 84, which act to engage vertical member 12 and hold bracket 23 in a cantilevered fashion. Cantilever portion 86 may optionally have screw holes bored through for affixing bracket 23 to various modular furniture pieces.

Bracket 23 is preferably provided with conductive metal plating 88, for example, nickel plating, to improve its electrical conductivity. A tough, insulative coating 90, such as provided by an industrial powder or plastic-dip coating rated for interior and exterior use, is then applied over nickel plating 88. Coating 90 is applied over the entire surface of bracket 23 except for face 80 and area 87 around screw hole 85. Nickel plating 88 is left exposed around screw hole 85 so that a wire lead from an electrical fixture can be electrically connected to bracket 23, as discussed hereinbelow in connection with FIG. 9. Nickel plating 88 is also left exposed at face 80 to provide electrical contact between bracket 23 and conductor 44 of vertical member 12 as shown in FIG. 3C.

FIG. 3C is a vertical cross-section through vertical member 12 showing how bracket 23 and vertical member 12 interlock. As shown, shank portion 80 of bracket 23 passes through slots in outer member 39 and conductor 44 of vertical member 12. When bracket 23 is lowered, notch 84 in bracket 23 engages the bottom portion of the slot in vertical member 12. At the same time, shank portion 82 extends above the top portion of the slot, thereby providing mechanical support for cantilever portion 86 and also providing electrical contact between the bare nickel plating on face 80 and conductor 44.

Referring back to FIG. 2, horizontal member 14 is structurally similar to outer member 39 of vertical member 12. Horizontal member 14 includes face portion 50 having a number of holes 51 bored through at a regular intervals along its length. Electrical sockets 25, similar to a socket for a phono or stereo headphones, are mounted in holes 51 with nuts 60. Electrical connector blocks 54, including spring pin 56, are mounted at both ends of horizontal member 14.

As shown in FIG. 2, the box-beam shaped portion of vertical member 12 has a plurality of holes 57 bored through its sides, thereby exposing a small portion of conductor 44. Horizontal member 14 is screwed or bolted to vertical member 12 with screw 62 at screw hole 64. When properly attached, spring pin 56 is biased against that portion of conductor 44 exposed via hole 57, thereby making electrical contact with conductor 44, or an interior portion of vertical member 12 in those embodiments wherein a separate conductor is omitted. Wiring 53 couples sockets 25 to connector block 54 in a series configuration to provide power to sockets 25. Channel 52, attached to face 50, encloses and protects sockets 25, wiring 53 and connector blocks 54, while adding rigidity to horizontal member 14. As with vertical member 12, face 50 and channel 52 are preferably insulated by a powder or plastic-dip coating.

Figure 4A:
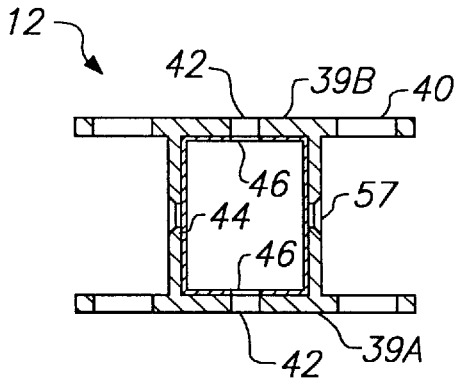
FIGS. 4A through 4F show alternative exemplary embodiments of the vertical shelf standards of FIGS. 1 and 2.
Figure 4B:
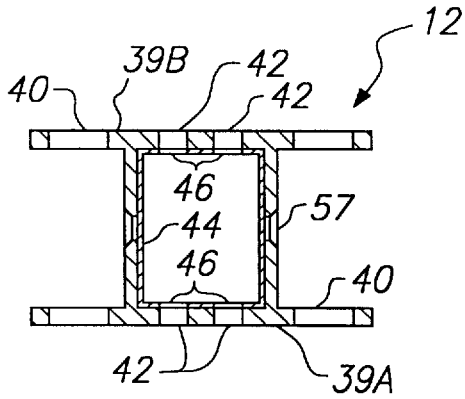
Figure 4C:
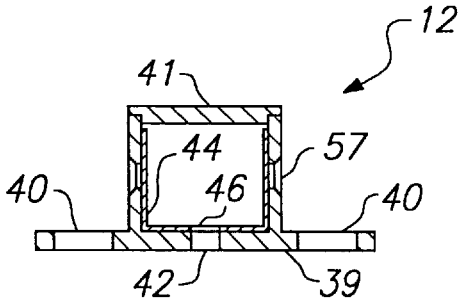
Figure 4D:
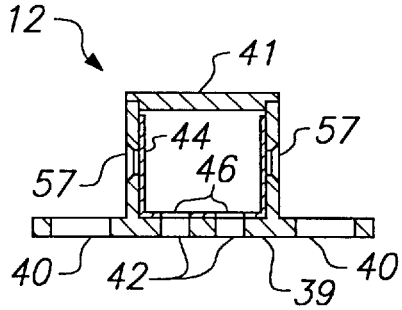

Cross sectional views of various illustrative embodiments of vertical member 12 are shown in FIGS. 4A through 4F. The cross section shown in FIG. 4D corresponds to the embodiment of vertical member 12 shown in FIG. 2, including two columns of slots 42 in outer member 39 and corresponding slots 46 in conductor 44. Outer member 39 also includes side holes 57, panel mounting holes 40 and cap 41. An alternative embodiment having only a single column of slots 42 is shown in FIG. 4C; otherwise, the embodiment of FIG. 4C is the same as that shown in FIG. 4D. Furthermore, the embodiments illustratively depicted in FIGS. 4A and 4B, are constructed similarly to those shown in FIGS. 4C and 4D, respectively, except that in FIGS. 4A and 4B the vertical element have slots in opposing sides 39*a* and 39*b*. Thus, the embodiments of FIGS. 4A and 4B may be used in situations wherein both the front and back of vertical members 12 may be visible, such as when a modular display is located in the center of a retail store.

Figure 4E:
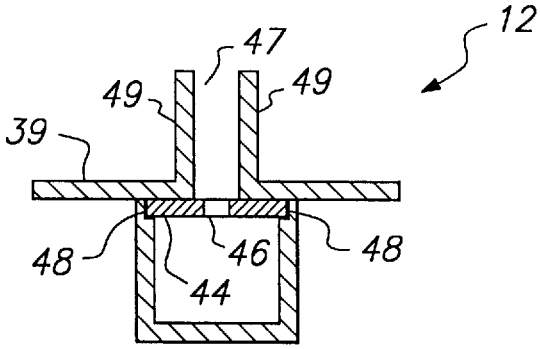
Figure 4F:
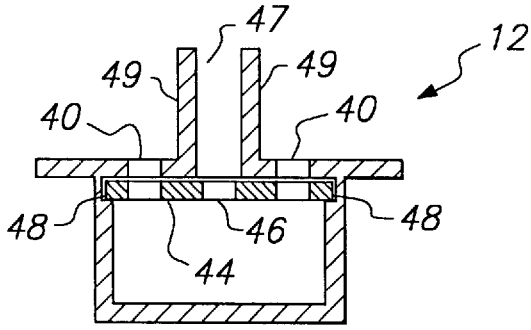

Referring now to FIGS. 4E and 4F, two additional, alternative embodiments of vertical members 12 are described. In these embodiments, outer member 39 is generally shaped like a channel including extensions 49 defining opening 47. Conductor 44 is generally shaped like an elongated bar or plate, and has a series of slots 46 spaced along its length. Conductor 44 is received into slots 48 on the inside of outer member 39, which hold the conductor in a position set back from opening 47 such that slots 46 are aligned with opening 47. Thus, when bracket 23 (FIGS. 1 and 3A–3C) is engaged in slot 46 in conductor 44, conductor 44 vertically supports bracket 23 in a cantilevered fashion, while extensions 49 of outer member 39 provide lateral support.

Figure 5:
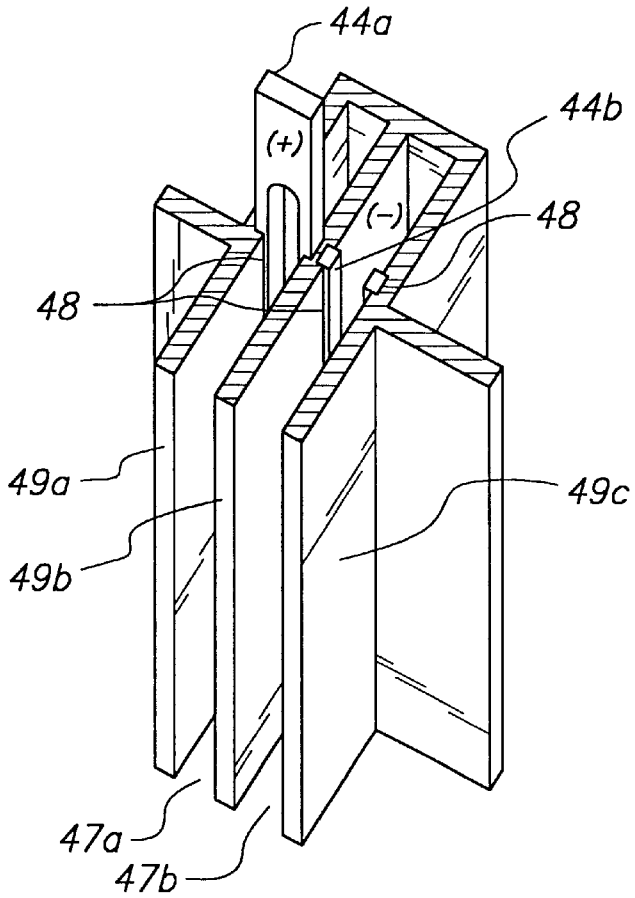
FIG. 5 shows a dual polarity embodiment of vertical member 12 of FIG. 1.

Yet another embodiment of vertical member 12 is shown in FIG. 5, wherein outer member 39 includes extensions 49*a*–49*c* defining a pair of adjacent openings 47*a* and 47*b*. Conductors 44*a* and 44*b* are mounted into slots 48 located on the inside of, and set back from openings 47*a* and 47*b*. This embodiment of vertical member 12 may thus provide multiple voltages or multiple voltage polarities in a single vertical member. For example, conductors 44*a* and 44*b* may be coupled in an electric circuit so that conductor 44*a* is the hot or live side of the circuit and conductor 44*b* is the ground, or return, side of the circuit.

In FIGS. 4A through 4D, conductor 44 is disposed such that openings 46 are aligned with corresponding openings 42 in outer member 39, whereas in FIGS. 4E–F and in FIG. 5, openings 46 are aligned with opening 47. In each of these embodiments, a portion of bracket 23 of FIG. 3A is passed through slots 46 in conductor 44 so that face 80 may make contact therewith. Additional alternative embodiments of vertical member 12 of FIG. 1 are shown in FIGS. 6A and 6B.

Figure 6A:
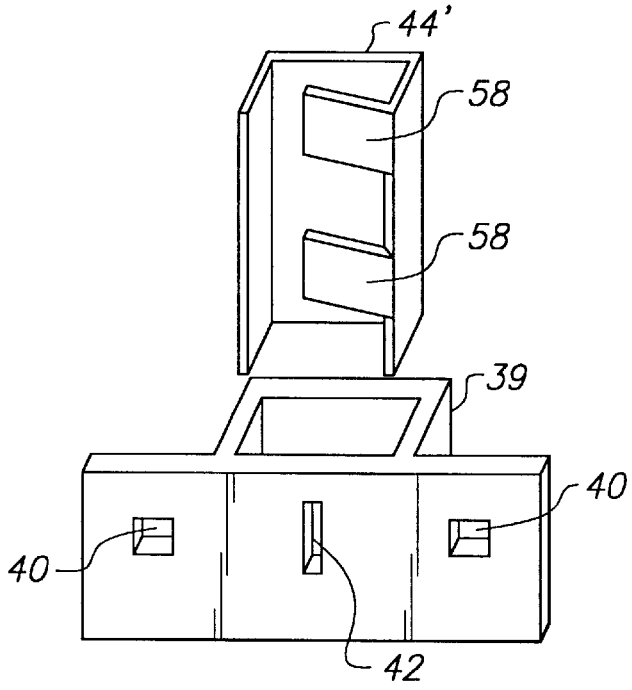
FIGS. 6A and 6B are alternative illustrative embodiments of the vertical shelf standards of FIGS. 1 and 2.
Figure 6B:
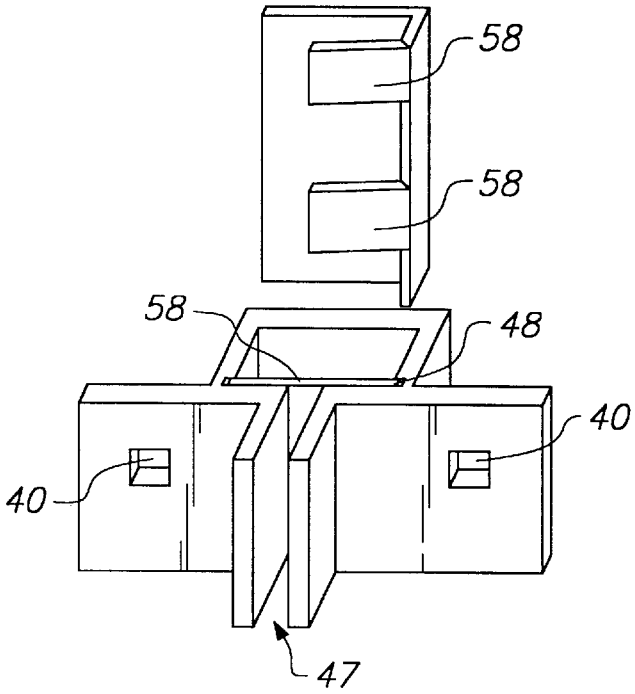

Referring now to FIGS. 6A and 6B, outer member 39 may be substantially identical to outer member 39 of any of FIGS. 4A through 4D. However, conductor 44' differs from conductor 44 in that it includes a plurality of tabs 58 instead of slots 46. When assembled into outer member 39, tabs 58 are aligned with corresponding slots 42.

Figure 7:
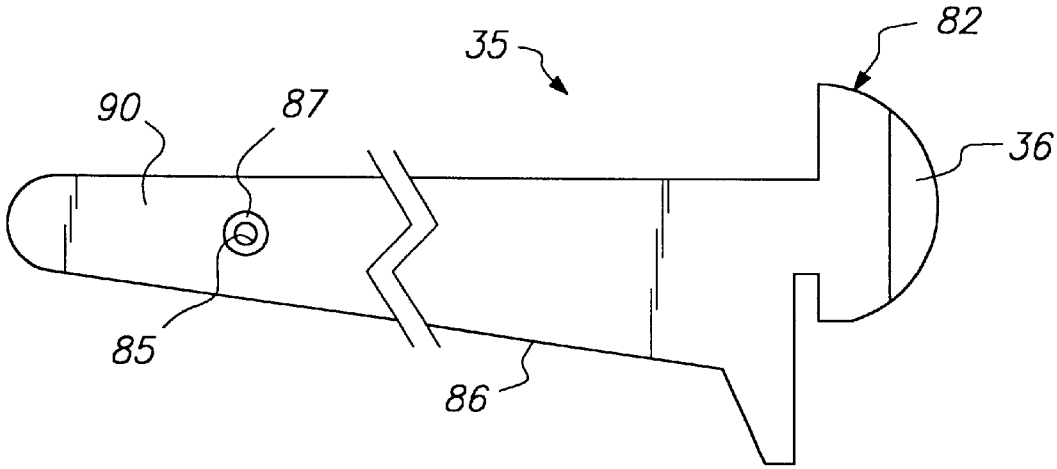
FIG. 7 is a support bracket for use with the standards of FIGS. 6A and 6B.

A bracket for use with the vertical members of FIGS. 6A and 6B is shown in FIG. 7. Bracket 35 is generally similar to bracket 23 of FIGS. 3A–C, and includes shank 82 and cantilever portion 86, covered with protective coating 90, except for area 87 surrounding screw hole 85. However, protective coating 90 is not applied to contact area 36 of shank 82. When inserted into a corresponding vertical member, shank 82 provides mechanical support for the bracket, while contact area 36 makes electrical contact with one of tabs 58. Preferably, tabs 58 exhibit a degree of elasticity, or springiness, such that tab 58 is biased against contact area 36 to ensure a good electrical connection.

Figure 8A:
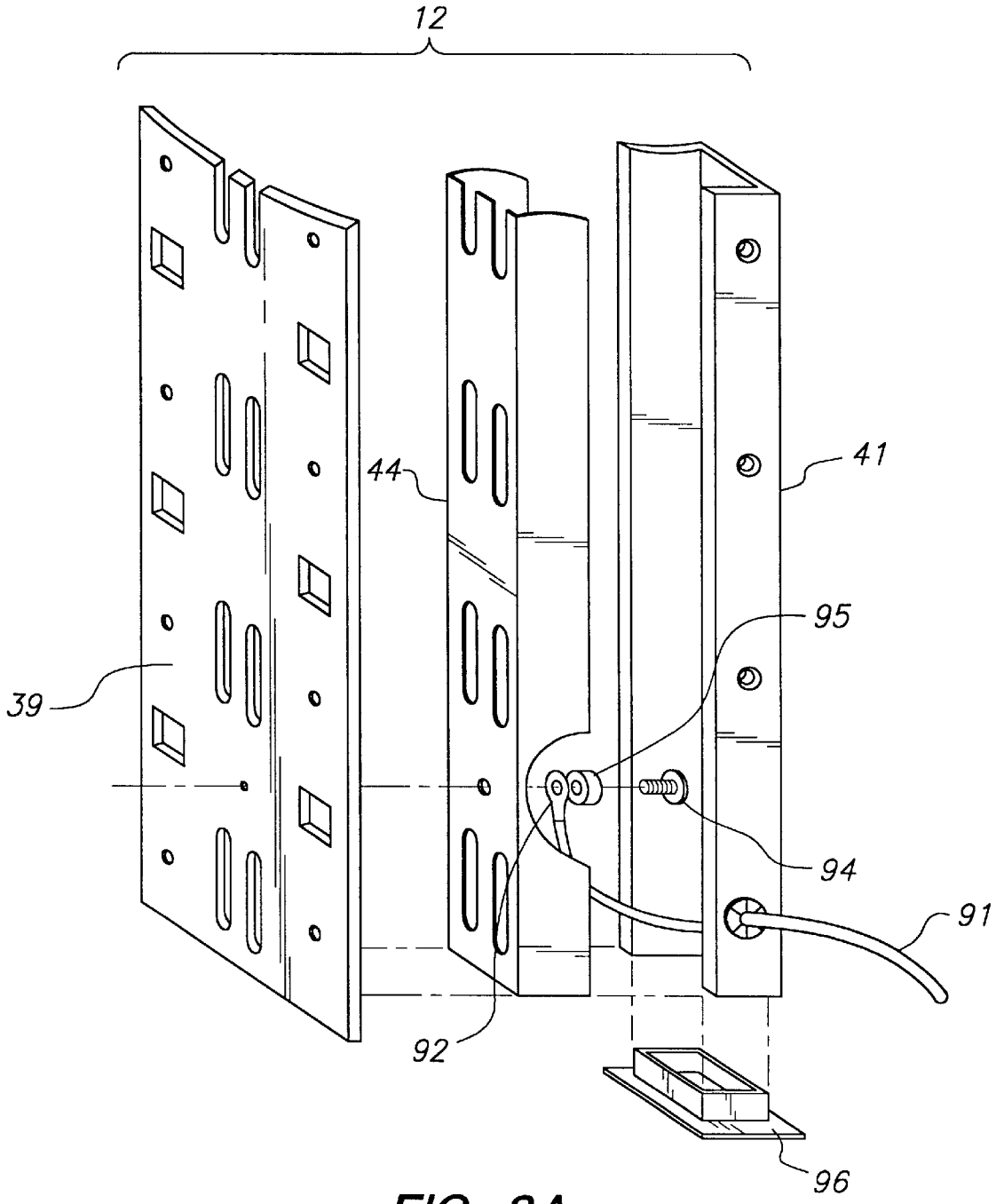
FIGS. 8A through 8D are detailed views showing various illustrative means of connecting a vertical shelf standard to a power source.

FIGS. 8A through 8D are detailed drawings showing various means of energizing conductors 44 of vertical members 12. In the embodiment of FIG. 8A, a wire 91 is screwed to a bottom portion of conductor 44 and strung to a power source for the modular furniture system. This method is mechanically and electrically simple keeping manufacturing costs low; however, each vertical member must be wired individually making set-up more costly and prone to wiring errors.

Figure 8B:
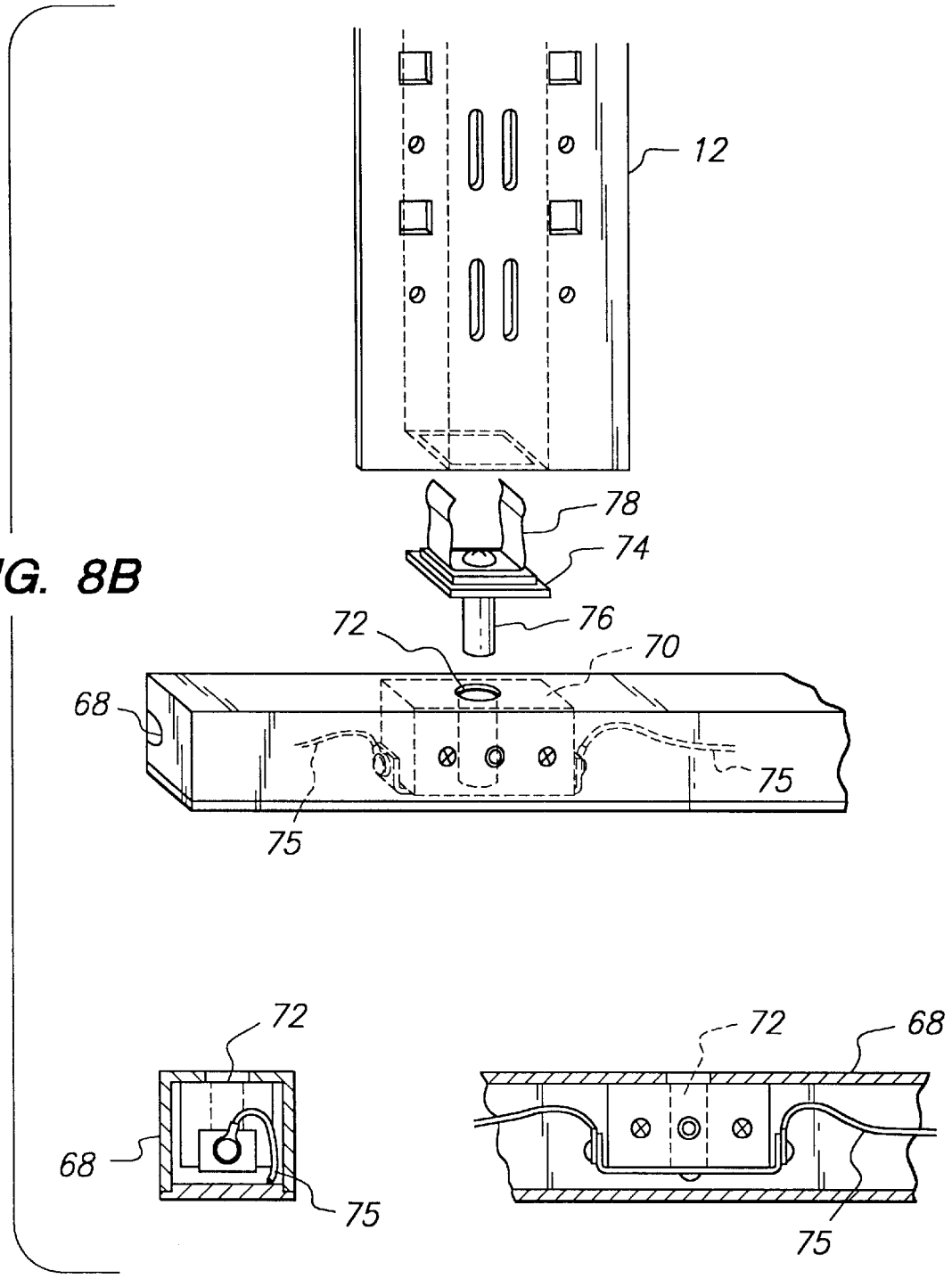

An alternative embodiment is shown in FIG. 8B, wherein sill member 68 is provided with plastic blocks 70 mounted below holes bored through an upper surface of sill 68 at regular intervals along its length. Plastic blocks 70 include socket 72 formed from brass, or other suitable material, and pressed into a hole in the block. Sockets 72 may then be connected with wire 75 in a daisy chain fashion such that adjacent sockets are of opposite polarity. In this embodiment, each vertical member 12 has a bottom cap 74 including brass pin 76 and bracket 78. Pin 76 is electrically connected to bracket 78, which in turn is soldered, or otherwise fastened, to conductor 44 of vertical member 12. Conductor 44 may therefore be energized by simply plugging pin 76 into corresponding socket 72 in sill 68. This provides essentially "fool-proof" wiring, but at a slightly elevated price due to the increased complexity involved in manufacturing sill 68.

Figure 8C:
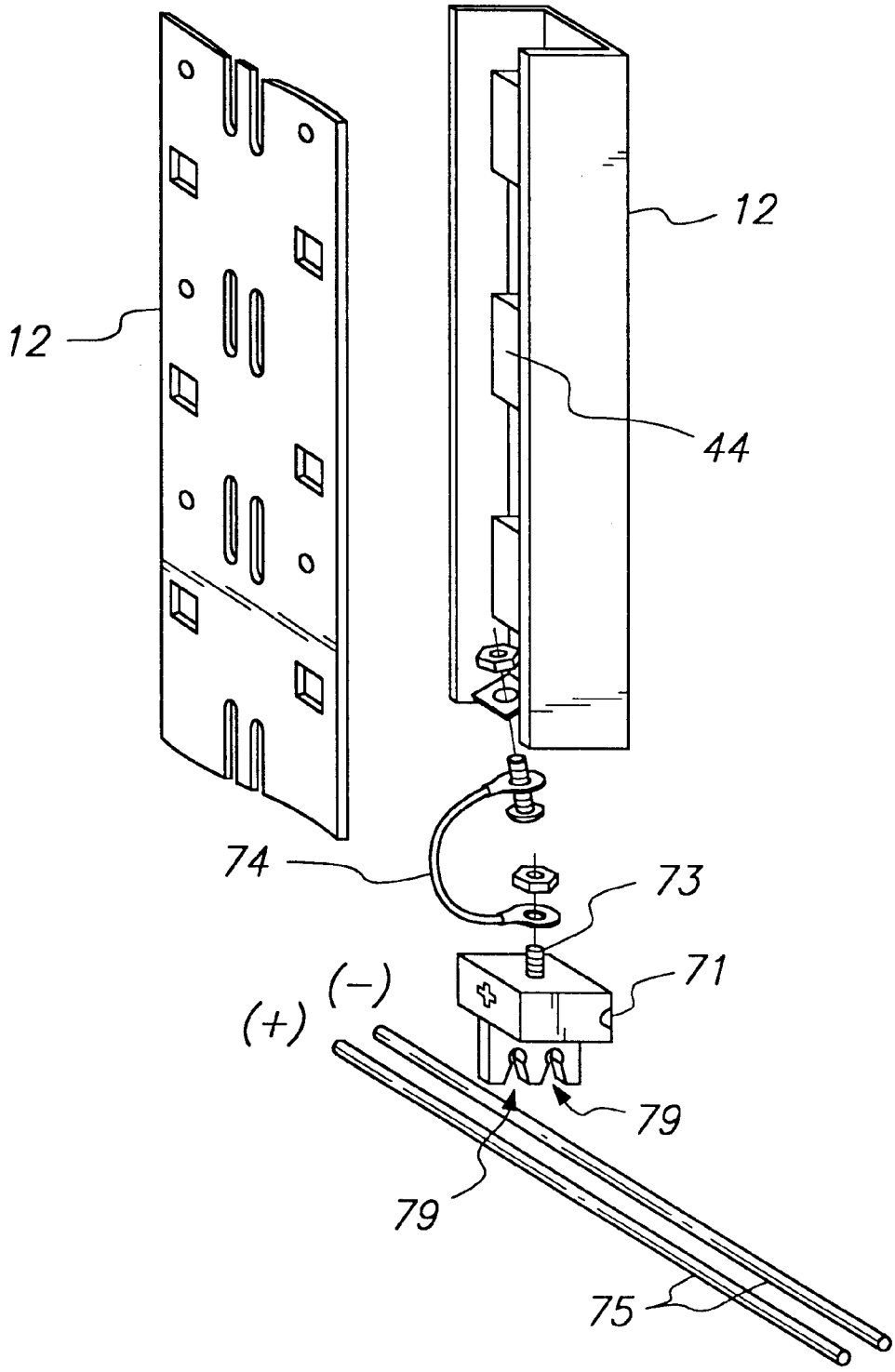
Figure 8D:
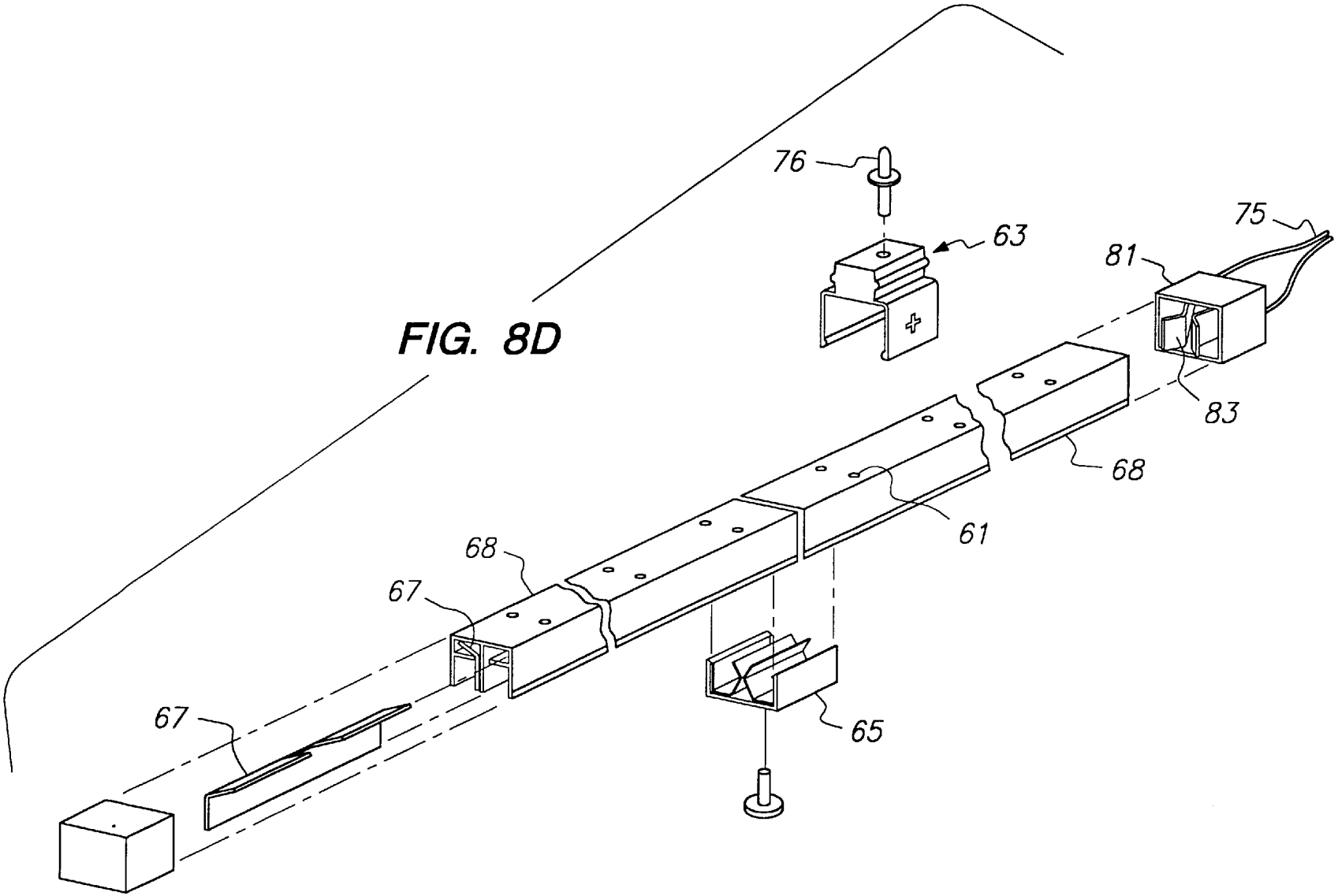

FIGS. 8C and 8D show additional alternative means of energizing the conductors 44 within vertical members 12. In FIG. 8C, plastic cap 71, designed to snap into a lower end of vertical member 12, includes threaded post 73 which may be coupled to conductor 44 by wire 77. A bottom portion of cap 71 includes notches 79 adapted to engage wires 75 which are disposed within a sill member (not shown). Preferably, one of notches 79 includes an insulation piercing tap (not shown) for piercing the insulating jacket of one of wires 75 to establish electrical contact. The tap is in turn electrically coupled to threaded post 73. Thus, an electrical connection is completed from one of wires 75 to conductor 44 via the tap, threaded post 73, and wire 77. By alternating which one of wires 75 is engaged by the tap, the polarity of adjacent vertical members is alternated according to the principles of the invention.

In FIG. 8D, sill 68 preferably comprises a plastic extrusion having two channels enclosing conductors 67. End cap 81, including metal tabs 83 coupled to wires 75, engages conductors 67 to provide power. Coupler 65 provides a means to couple conductors 67 in adjacent sills 68. Plastic cap 63 is designed to snap into an end of vertical member 12 of FIG. 1 and over sill 68. Cap 63 includes conductive pin 76 so that, when it is snapped to vertical member 12 and to sill 68, one end of pin 76 contacts a tab formed at the bottom of conductor 44, and the other end of pin 76 passes through hole 61 to contact one of conductors 67 in sill 68, thereby energizing conductor 44. Plastic cap 63 may be rotated 180 degrees to determine which one of conductors 67 are contacted by pin 76 to determine the polarity of conductor 44. Advantageously, this embodiment also ensures vertical members 12 are correctly spaced apart due to the alignment points provided by holes 61. As one skilled in the art will recognize the various features shown in FIGS. 8A through 8D may be used in combinations other than those shown therein.

Figure 9:
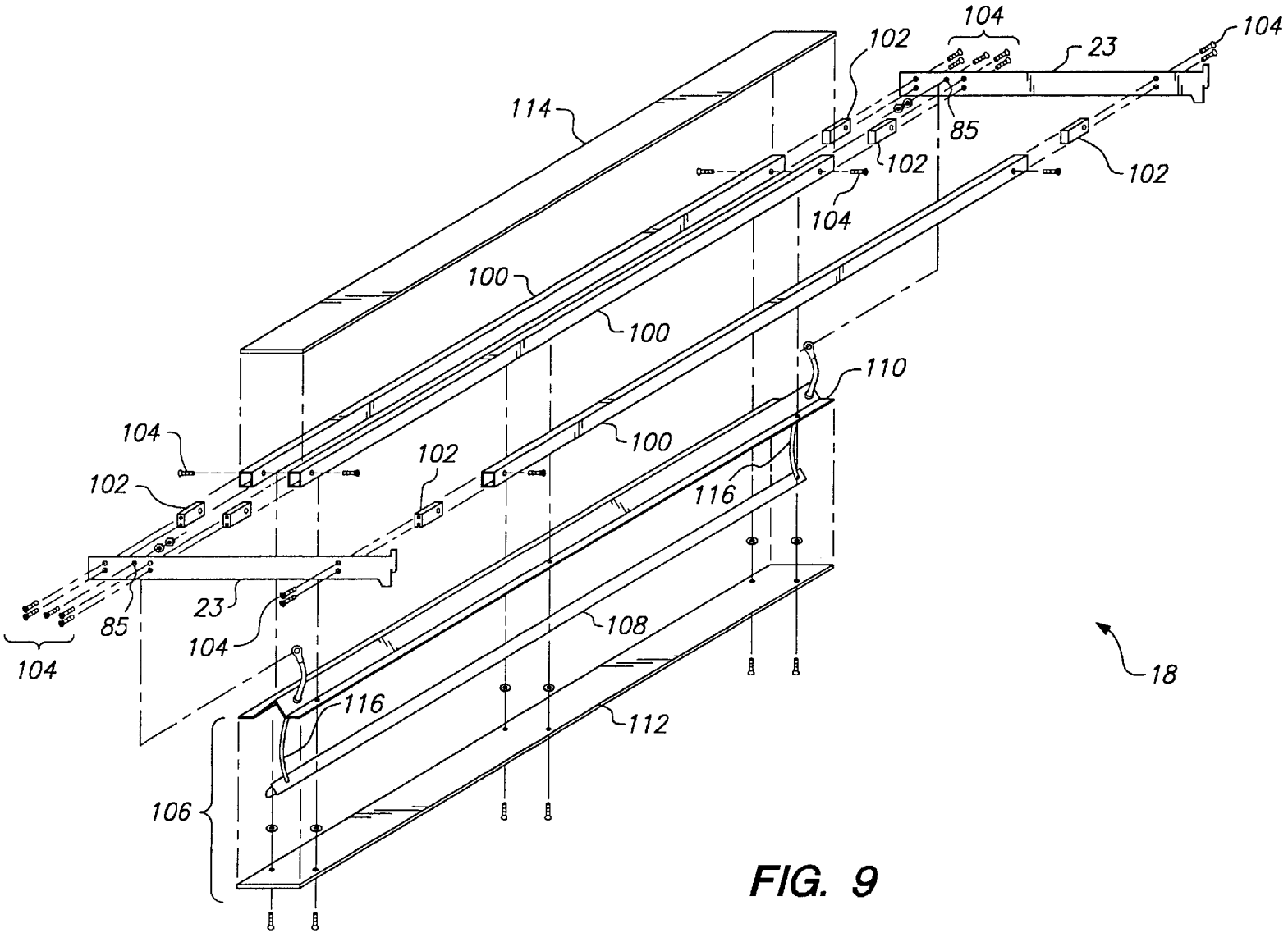
FIGS. 9 and 10 are exploded perspective views of illustrative embodiments of an under-shelf and a stand-alone light fixture, respectively.

Referring now to FIG. 9, the design of an illustrative embodiment of shelf support 18, including light fixture 106, is described. Brackets 23 are attached to each end of cross supports 100 using insulative blocks 102 and screws 104. Preferably, cross supports 100 are made of aluminum and insulator blocks 102 are made of a machinable plastic such as Nylon or Delrin. Light fixture 106, including lighting element 108, reflector 110, and bezel 112 is then attached to cross supports 100. Electrical leads 116 provided at either end of light fixture 106 are connected to corresponding brackets 23 through screw holes 85 such that leads 116 are electrically coupled to a portion of the nickel plating (see FIGS. 3A–3C) exposed through powder coating 90 at area 87. Heat reflector 114 provides thermal insulation to prevent damage to a shelf resting on the cantilever portions of brackets 23.

Figure 10:
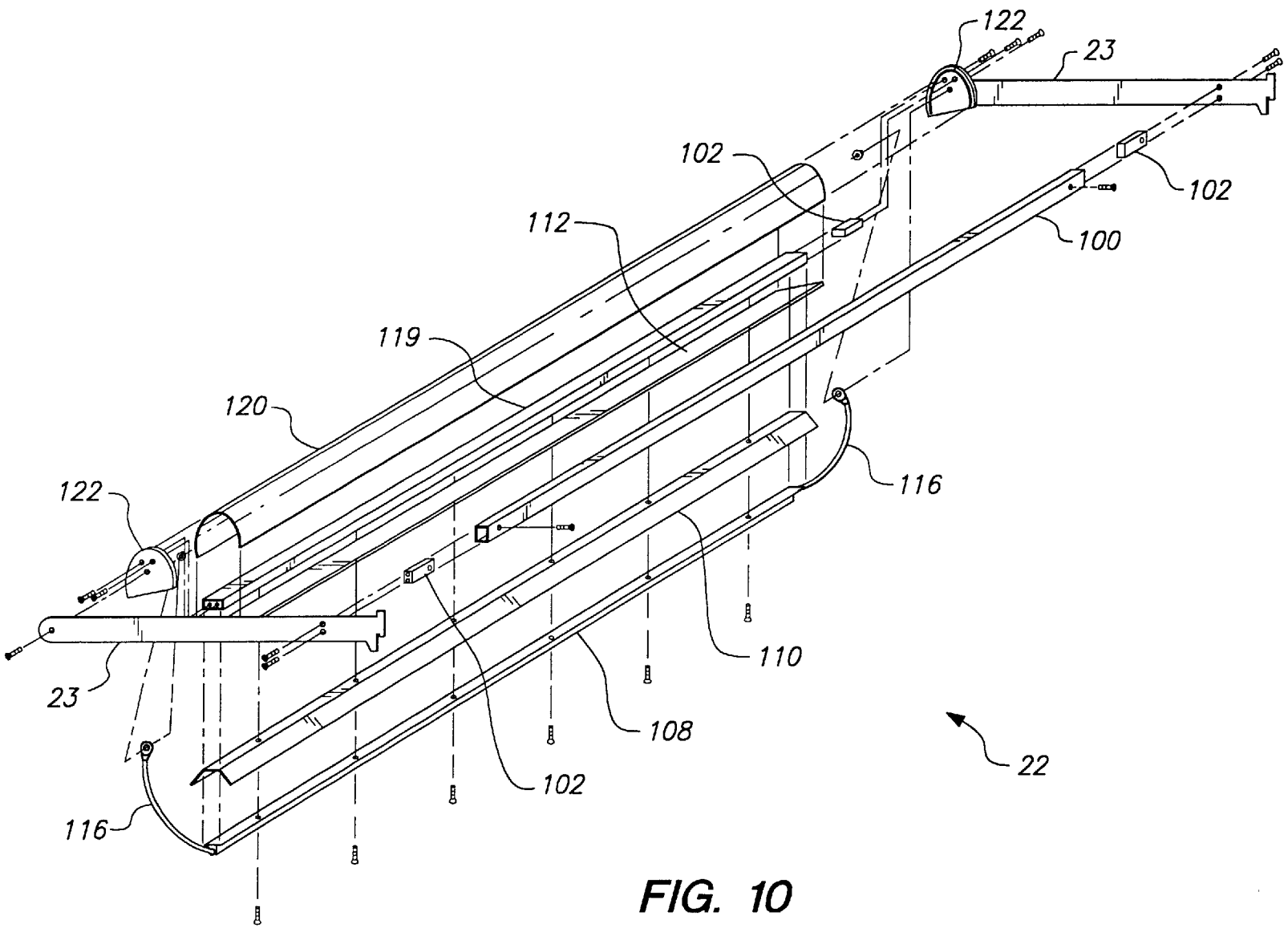

The light fixture 22 of FIG. 10 is similar in most respects to light fixture 18 of FIG. 9, including brackets 23, cross supports 100, and insulators 102. Lighting element 108 and reflector 110 are mounted to cross support 119. Lens 112, cross support 119, and cover 120 are in turn mounted between end pieces 122 to form a lamp module. End pieces 122 are pivotally mounted to brackets 23 such that the lamp module may be rotated around an axis running through its length.

Figure 11:
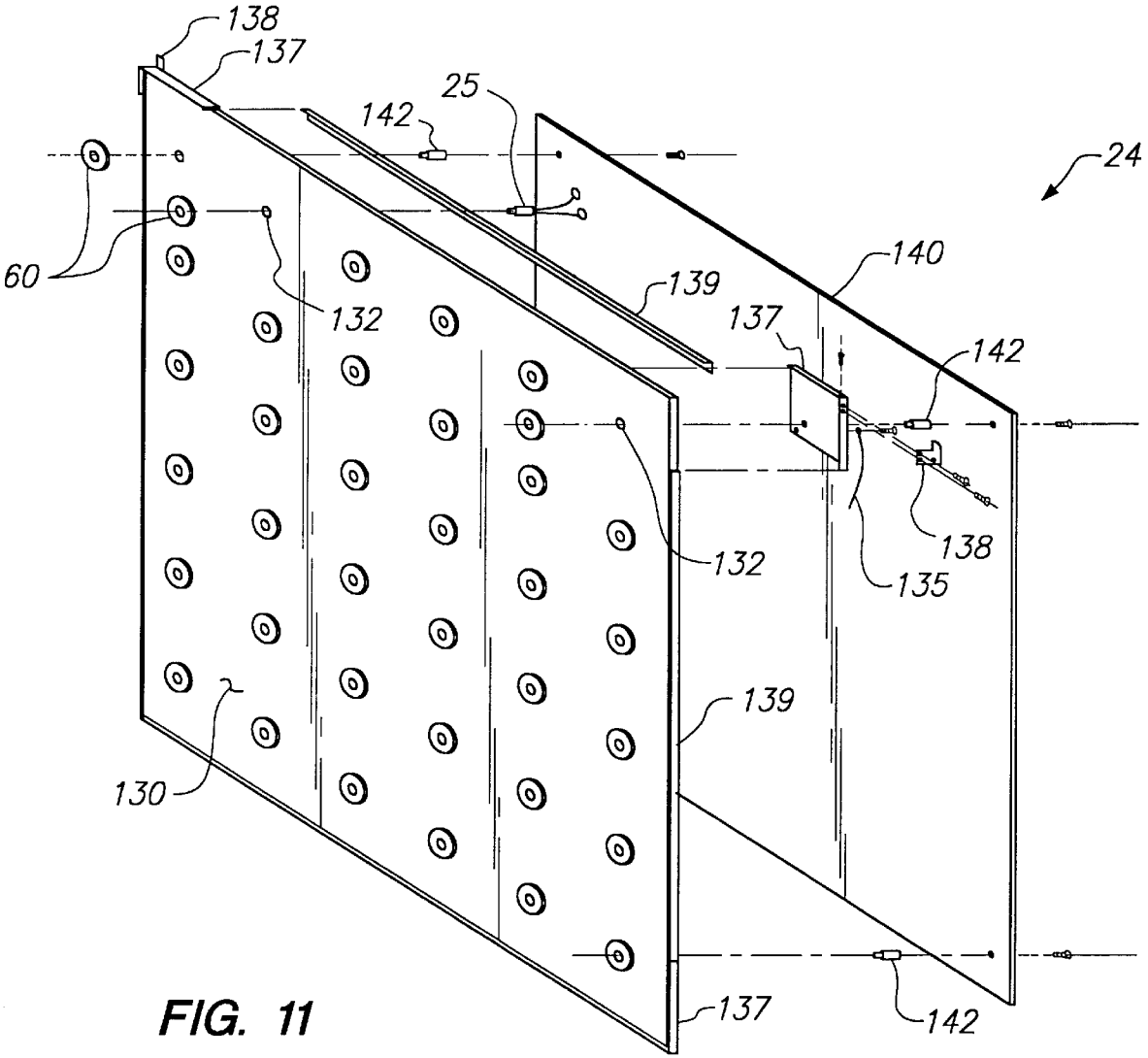
FIGS. 11 and 12 are, respectively, a perspective view of an illustrative powered panel and an electrical socket used therein.

FIG. 11 is more detailed view of powered panel 24 of FIG. 1. Powered panel 24 comprises sheet 130, made of plastic or other suitable material, having a plurality of holes 132. Although the holes are laid out in a rectangular grid in FIG. 8 this need not be the case. Each hole in plastic sheet 130 is fitted with a socket 25 held in place by nut 60. Conductive corner pieces 137 are attached to the corners of plastic sheet 130 to provide reinforcement of the sheet and to provide a place to attach brackets 138. Wiring, a portion of which is indicated by reference numeral 135, electrically couples sockets 25 to brackets 138. A back cover 140, mounted to plastic sheet 130 with spacers 142, covers and protects sockets 25 and wiring 135. Additionally, trim pieces 139 may be attached to provide powered panel 24 with a more finished appearance.

Figure 12:
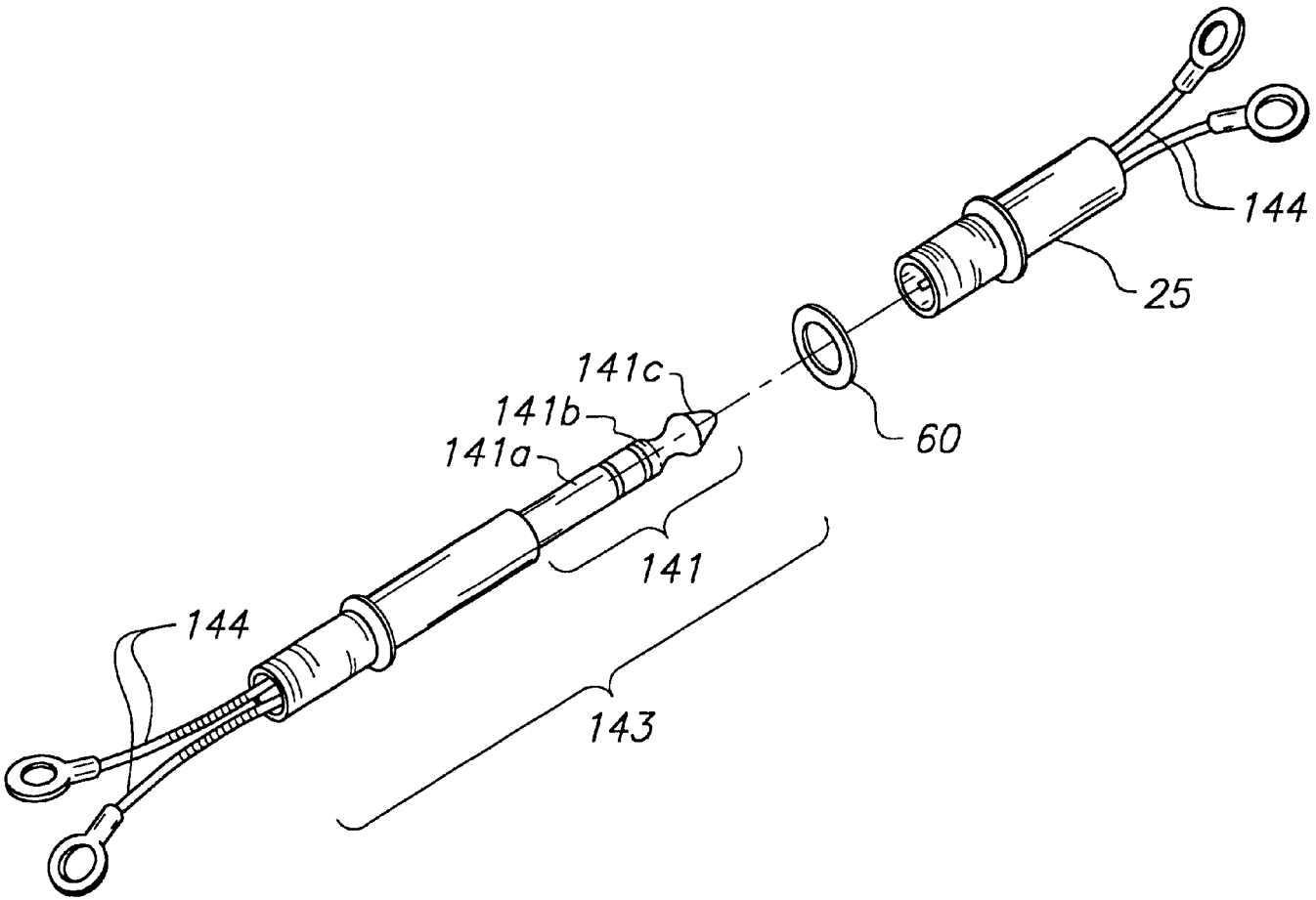

As shown in more detail in FIG. 12, socket 25 resembles a panel-mount socket for a ¼" phono jack. Jack 143, which resembles a ¼" phone jack, comprises tip portion 141 including two or more conductors, 141*a,* 141*b,* and 141*c,* which connect with corresponding contacts internal to socket 25. When inserted into socket 25, jack 143 may provide electrical power to a device connected to leads 144. Additionally, jack 143 may act as a mounting device for small electrical fixtures such as spot-light 26 of FIG. 1 or desk lamp 170 of FIG. 13.

Figure 13:
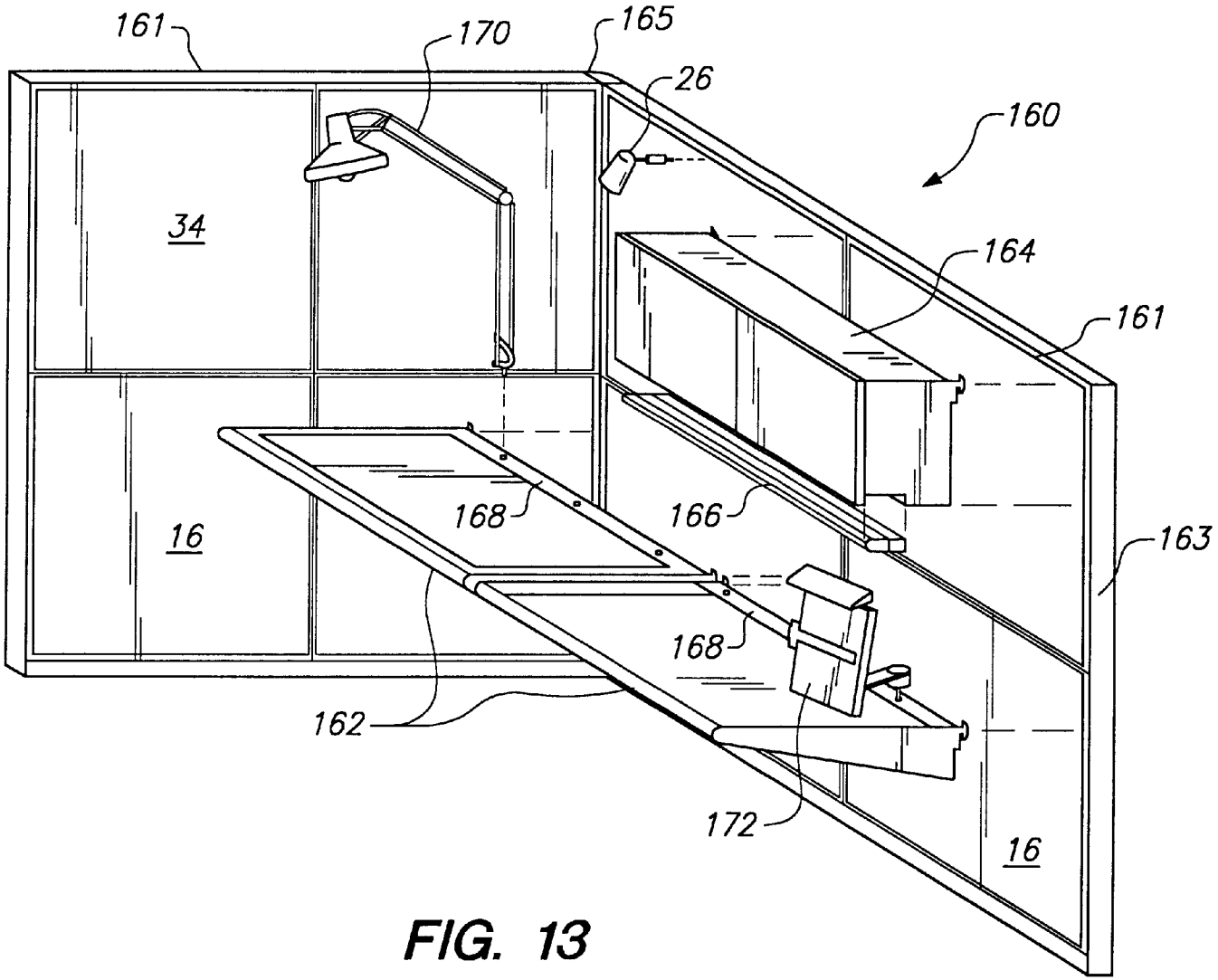
FIG. 13 is an exploded, perspective view of an illustrative office partition system according to another aspect of the present invention.

Referring now to FIG. 13, the principles of the present invention are shown in an embodiment useful for modular partitions for use in an office environment. As in FIG. 1, a frame work is constructed of horizontal and vertical members (hidden from view) and modular panels 16 are attached thereto. However, because partition 160 may be free standing, i.e. not be attached to a supporting wall or ceiling, caps 161, sills (not shown), edges 163, and corner pieces 165 are used to provide additional structural rigidity and to provide a more aesthetic and finished look to the visible edges of partition 160. Furthermore, since both faces of partition 160 may be exposed to view, panels 16 may be attached to both sides of partition 160. A power source for partition 160 may be located in the space behind one of panels 16.

Shown attached to partition 160 are desks 162 and book shelf or cabinet 164. The power provided by vertical members 12 may be used advantageously to power lights within desk 162 thereby providing internal illumination for the surface of desks 162 and making them suitable for viewing x-rays or photographic slides. Alternatively, a light box, similar to light box 34 of FIG. 1, may be installed in partition 160 for viewing x-rays and other transparent media. Although not shown, light box 34 of FIG. 1 is attached to modular wall unit 10 using brackets substantially identical to brackets 138 of FIG. 11. Auxiliary power strip 168, which is similar in construction to horizontal member 14 of FIG. 2, may be located along a rear edge of desk 162 to provide a convenient method for attaching and powering desk lamp 170 and copy holder 172, as well as other powered and non-powered accessory items (not shown). Additionally, bookshelf or cabinet 164 may obtain electrical power from partition 160 to energize under-shelf light fixture 166 to provide suitable task lighting for desks 162. Spot-light 26 may also obtain power from partition 160.

Figure 14:
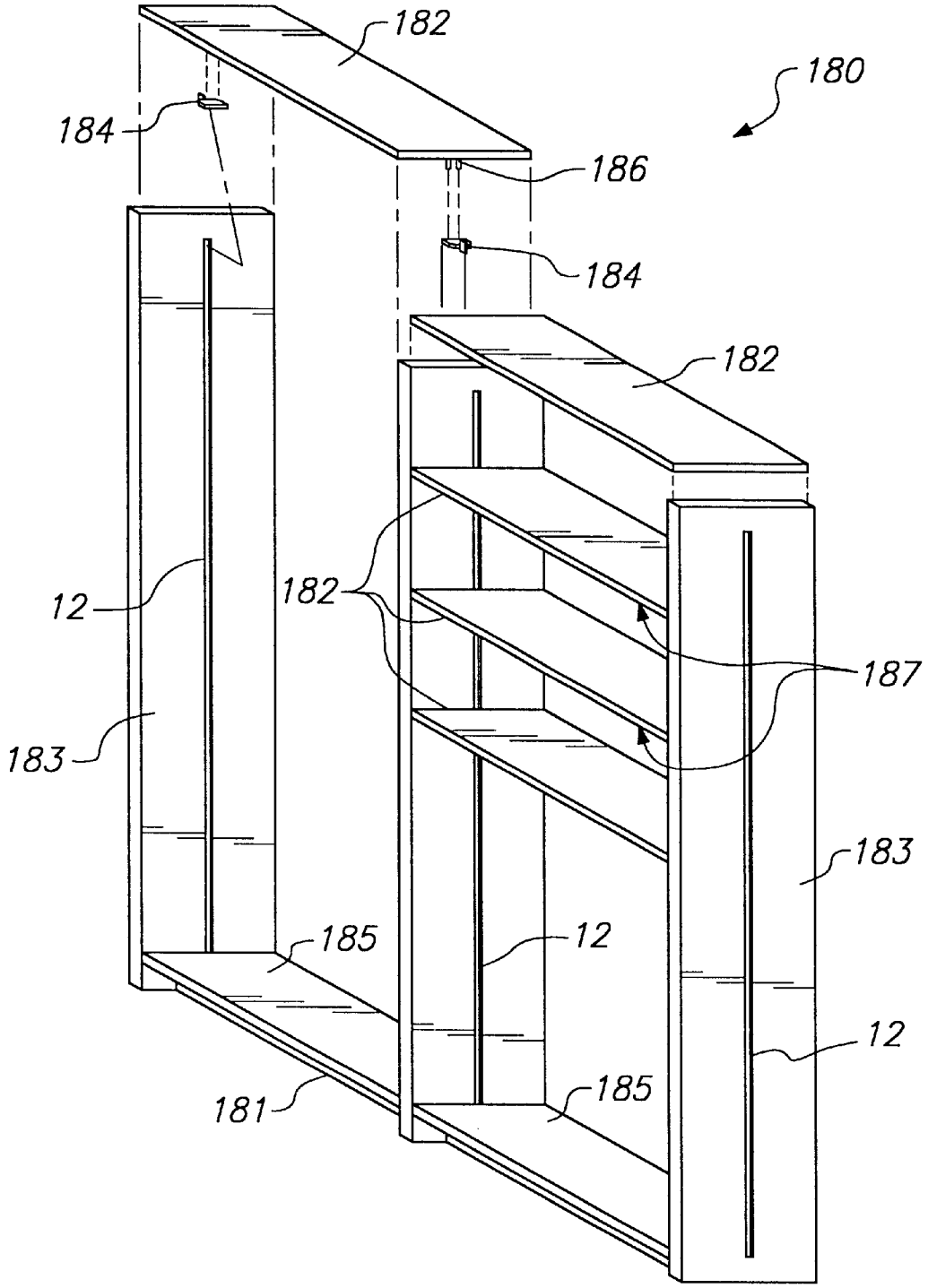
FIG. 14 depicts a perspective view of a bookcase constructed in accordance with yet another aspect of the invention.

Yet another embodiment of the present invention is shown by way of bookcase 180, shown in FIG. 14. Bookcase 180, which may be either free standing or attached to a supporting wall, includes base 181, vertical sides 183 and shelves 182 and 185. Vertical members 12 are mounted into grooves or slots in vertical sides 183. Shelves 182, which may be adjustable or fixed, are supported by shelf supports 184 attached to vertical members 12. Shelves 182 may contain under-shelf light fixture 187 (see FIG. 15). Shelf supports 184 include a portion shaped like bracket 23 of FIG. 3A for engaging vertical members 12 and a block portion for supporting shelves 182. A power supply (not shown) for bookcase 180 may be hidden within base 181.

Figure 15:
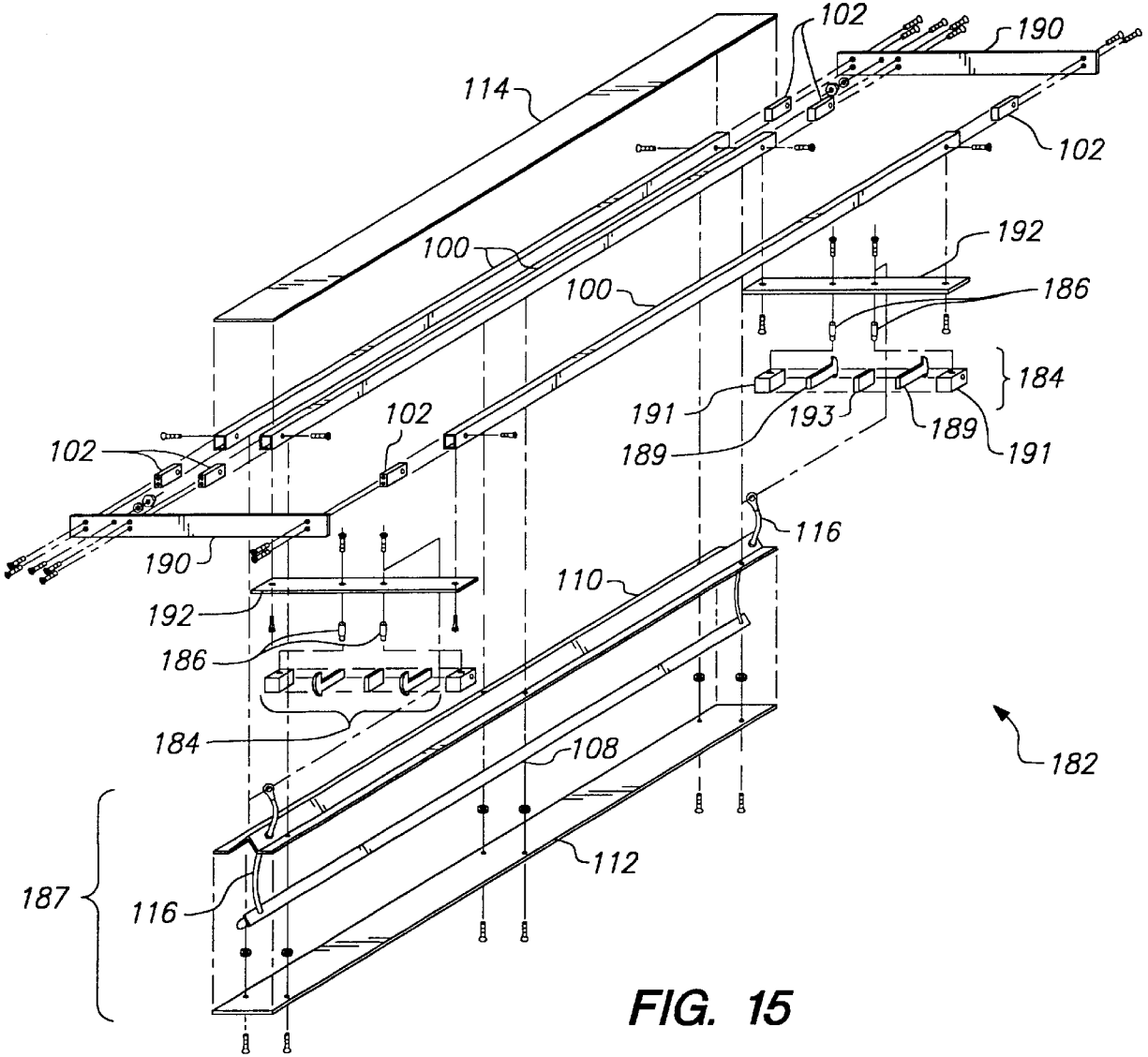
FIG. 15 shows a lighted shelf for use in the bookcase of FIG. 14.

Under-shelf light fixture 187 for use with bookcase 180, and shelf supports 184 for supporting shelves 182 are shown in more detail in FIG. 15. Light fixture 187 is similar in many respects to light fixture 106 discussed hereinabove in connection with FIG. 9, including cross members 100, insulators 102, light strip 108, reflector 110, bezel 112, heat reflector 114, and connecting wires 116. However, in FIG. 15 support brackets 23 of FIG. 9 are replaced by end pieces 190 and 192 which form an L-shaped unit.

Shelf supports 184 comprise small brackets 189, shaped like shank portion 82 of bracket 23 of FIG. 3A, and spacer 193 which separates brackets 189 so that they may properly engage corresponding slots in vertical member 12. Blocks 191 are affixed to brackets 189 to provide a ledge for supporting shelves 182. Blocks 191 also include a socket mounted in their upper surface, wherein the socket is electrically connected to brackets 189. Pins 186 project downward from end piece 192 of light fixture 187 to provide electrical coupling between end piece 192 and the sockets in support brackets 189, and to prevent shelf 182 from sliding off of bracket 184.

Figure 16:
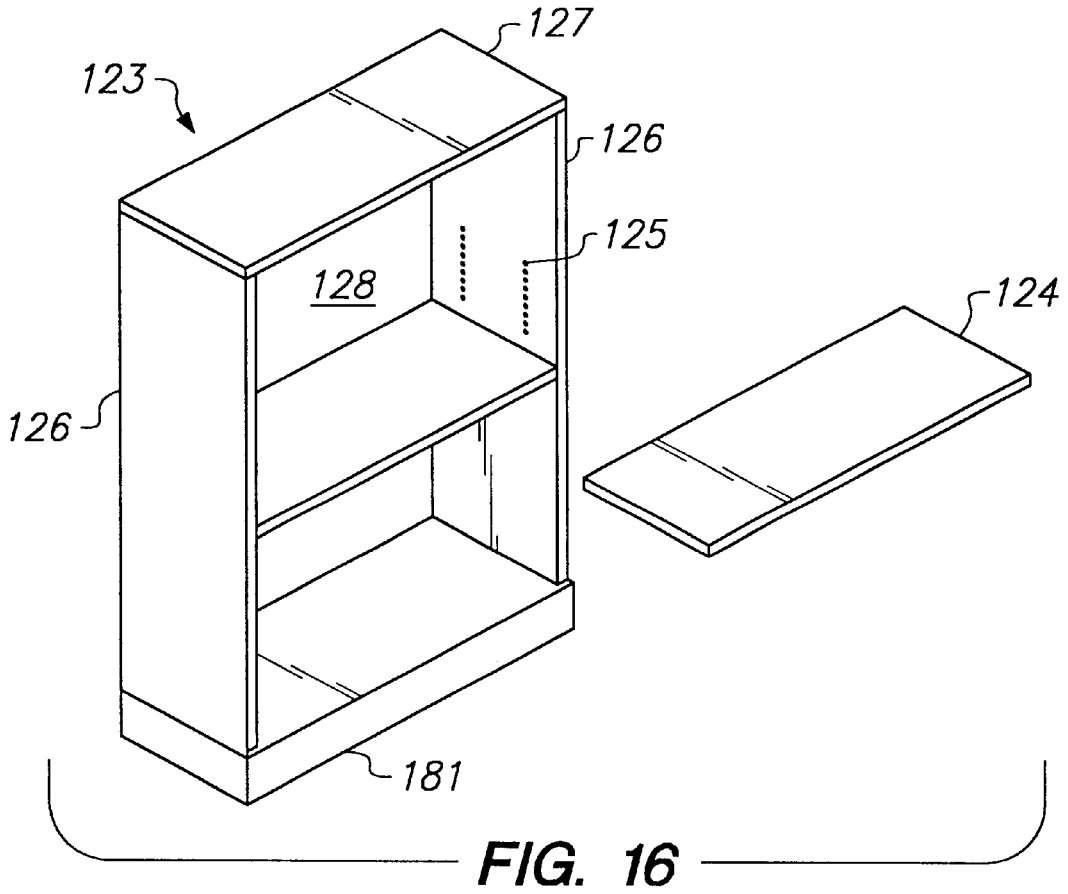
FIG. 16 is a perspective view of an alternative illustrative embodiment of a bookcase in accordance with the present invention.

An alternative embodiment of a display case according to the present invention is shown in FIG. 16. Display case 123 is similar to book case 180 of FIG. 14, except that display case 123 supports adjustable shelves 124 by pins or pegs inserted into holes 125 arranged in columns in sides 126 of the display case. Conductive tracks are disposed within the sides such that when the pins are inserted into the holes the pins make electrical contact with the conductive tracks. An electrical fixture disposed on a shelf receives power through electrical contact with the special pins. A low voltage power supply, which may be hidden in base 181, energizes the conductive tracks to opposite polarities thereby energizing the electrical fixture.

Display case 123 includes sides 126, base 181, top 127, back 128, and shelves 124. Sides 126 include columns of spaced holes 125. Pins inserted into corresponding ones of holes 125 provide support for adjustable shelves 124, which may be relocated by moving the pins to various sets of holes 125.

Figure 17A:
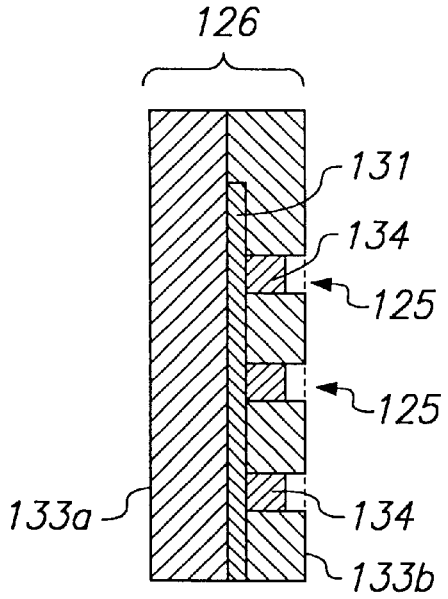
FIGS. 17A and 17B are cross sections of alternative embodiments of the sides of the bookcase of FIG. 16.
Figure 17B:
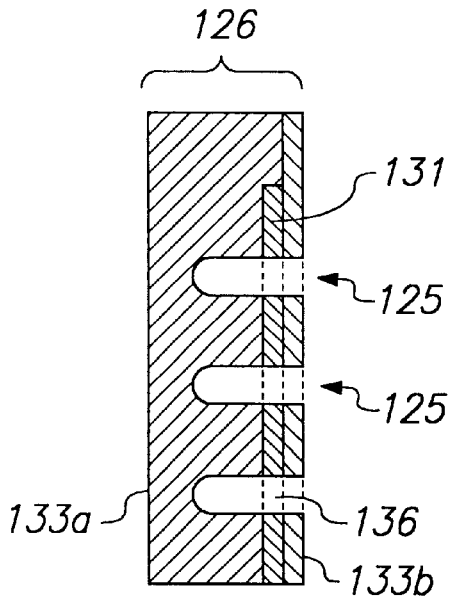

As shown in FIGS. 17A and 17B, conductive track 131 is disposed behind holes 125 in side 126, which are preferably of a sandwich type construction, such that conductive track 131 is enclosed between layers 133*a* and 133*b*, made of wood or other suitable material. In the embodiment of FIG. 17A, layer 133*b* has a significant thickness, therefore, conductive track 131 includes pin casings 134, resembling short tubes, which extend into, but do not protrude through, layer 133*b* to ensure sufficient electrical contact between a pin and conductor 131. Alternatively, layer 131*b* may comprise a relatively thin veneer, as shown in FIG. 17B. Therefore, conductive track 131 may comprise bar stock having a series of holes 136 along its length such that a pin contacts track 131 in one of holes 136.

An illustrative pin and fixture for use in connection with display case 123 of FIG. 16 are shown in FIG. 18. Pin 129 comprises a small block 142, made of plastic or other suitable material, such as wood, or insulated metal. Conductive pin 145 protrudes from one face of block 142, and conductive socket 146 is disposed in an upper surface of block 142 and electrically coupled to pin 145.

Fixture 147, including light strip 148, reflector 149, and lens 150, may be mounted in a recess on the underside of shelf 124. End portion 151 of fixture 147 includes pin 152 which is electrically coupled, as by a wire or other suitable means, to lamps 153 of light strip 148. Pin 152 is also adapted to electrically and mechanically engage socket 146 of support pin 129. A similar end portion is disposed on the opposite end of fixture 147 (not shown) to engage a support pin on the opposite side of display case 123, thereby completing a circuit for powering lamps 153.

An alternate method of coupling an under shelf fixture to conductive track 131 is shown in FIG. 19. Lighting fixture 147 is preferably recessed into the underside of shelf 124. Spring steel sleeve 154, having an "omega-shaped" cross section, is disposed in grooves 155, and is coupled to lamps 153 of lighting fixture 147 by fixed pin 156 and wire 157. Shelf support pins 129, which resemble short conductive rods, are inserted into holes 125 in sides 126 of display case 123. When shelf 124 is brought down onto supports pins 129, sleeve 154 deforms and snaps onto the support pin. The action of sleeve 154 on support pin 129 provides both good electrical contact for powering light fixture 147 and good mechanical support to prevent shelf 124 from being removed from display case 123 accidentally.

Figure 20:
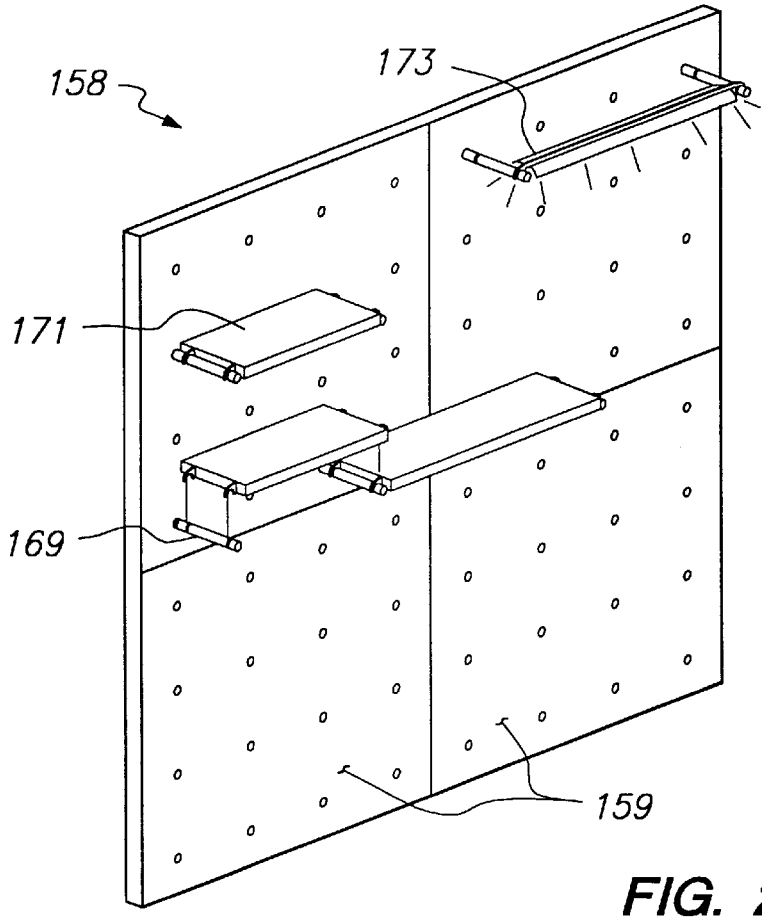
FIG. 20 is an illustrative embodiment of an alternative wall system in accordance with the present invention.
Figure 21:
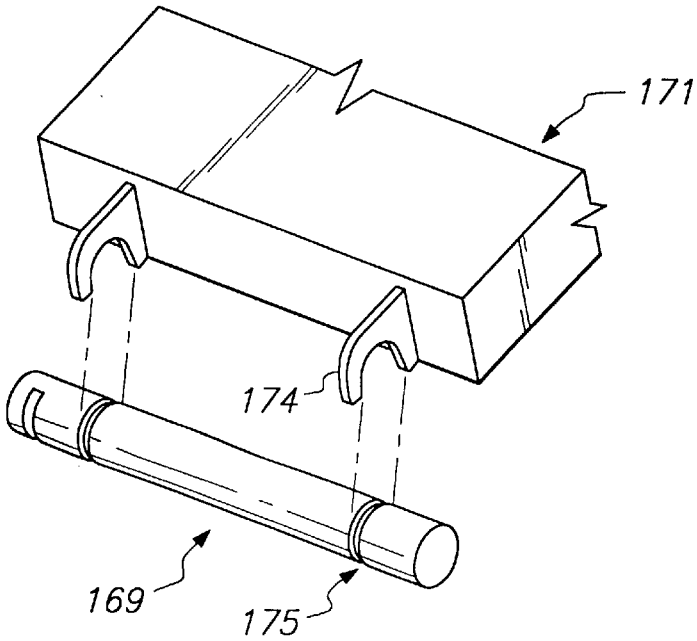
FIG. 21 is a perspective view showing the interface between a support rod and shelf of FIG. 20.

Referring now to FIG. 20, another common display system adapted according to the principles of the present invention is described. Display 158 comprises a number of panels 159 including an array of sockets or pucks. Support rods 169, designed to engage the sockets or pucks, support shelves 171, lights 173, and other devices such as clothes rods, signs, and the like, using hooks 174 which fit into grooves 175 in support rods 169, as shown in FIG. 21. In accordance with the principles of the present invention, support rods 169 couple both mechanically and electrically with the sockets and/or pucks to provide support as well as a source of electrical power.

Referring now to FIG. 22, the peg and puck systems are described in more detail. Sockets 167 and pucks 168 are inserted into holes 176 in panels 159 and coupled to conductors 177 disposed behind panels 159. Conductors 177 may comprise metal bar stock having holes bored in locations along its length that correspond to holes 176 in panels 159. Sockets 167 may have a threaded shaft portion which is passed through holes 176 in panels 159 and conductors 177 and secured by nut 178. Alternatively, conductor 177 may comprise a wire that is wedged under nut 178, or an end portion of sockets 167 and pucks 168 may include a tap similar to that shown on plastic cap 71 of FIG. 8C. Conductor 177 is coupled to a source of low voltage electrical power by wire 91, or by one of the other methods shown in FIGS. 8A through 8D.

Peg 169 comprises a conductive rod having an electrically insulative material, such as a plastic or powder coating, disposed along a substantial length thereof. End portion 195, which is not insulated, is adapted to be inserted into and mechanically and electrically coupled to socket 167. For example, end portion 195 may include pin 196 keyed to helical slot 197 in a side of socket 167, so that peg 169 must be inserted into socket 167 with a twisting motion. Contact between pin 196 and helical slot 197 provides a structurally sound mechanical connection, as well as good electrical contact. Circumferential grooves 175 expose portions of the conductive rod to provide for contact with hooks 174 of FIG. 21. Preferably, grooves 175 are wide enough to accommodate the width of two hooks, so that adjacent shelves may be supported by a common peg.

In a puck type system, pucks 168 comprise plastic disc 199 disposed on the end of short threaded, conductive, rod which is attached to conductor 177 and panel 159 as described above. Flange portion 188 keeps plastic disc 199 spaced apart from the surface of panel 159 so that a suitable adapted end of support rod 169 may fit over and engage disk 199 to provide mechanical support. The end of support rod 169 is also adapted to contact flange portion 188 to make an electrical connection therewith. In other respects, the support rods, shelves, lights, and other fixtures are identical to those used in the peg system.

Figure 23A:
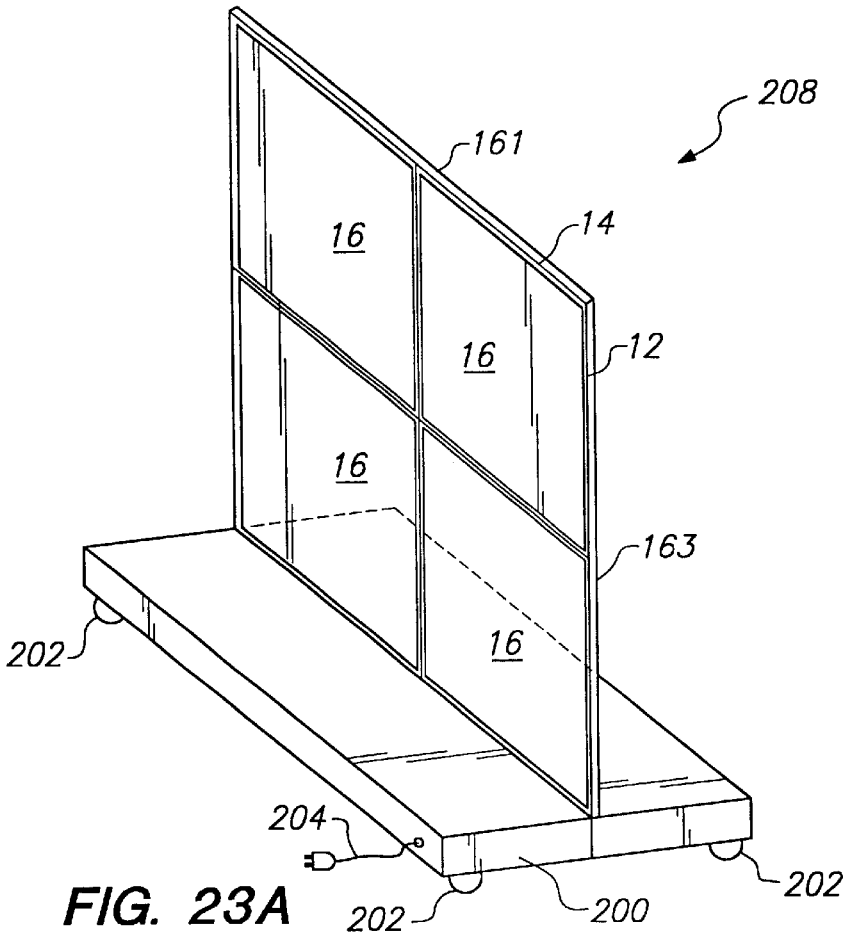
FIGS. 23A and 23B are perspective views of a mobile display unit constructed in accordance with the principles of the present invention.
Figure 23B:
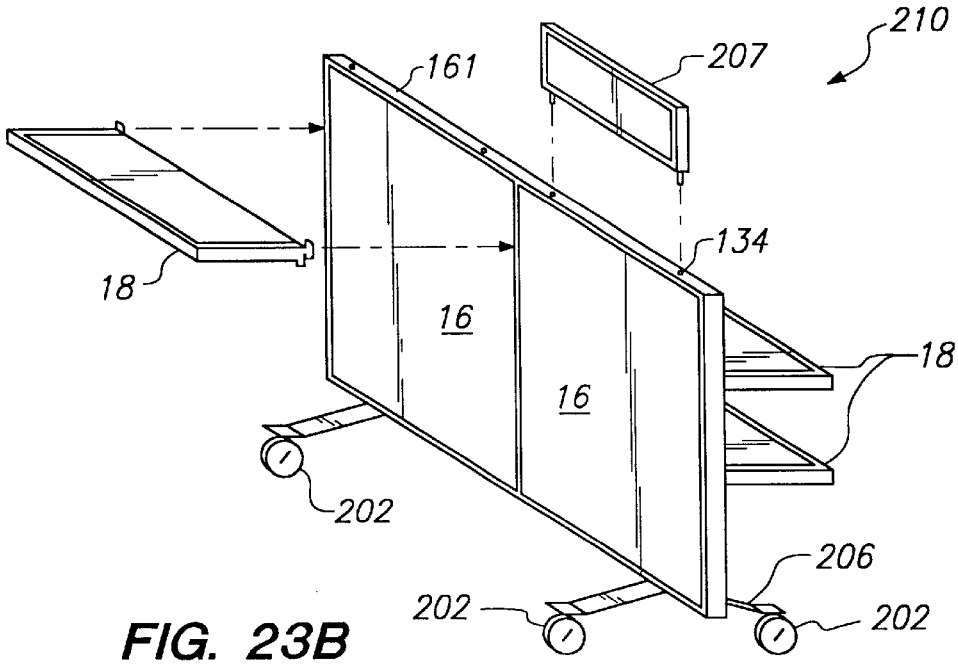

Referring now to FIGS. 23A and 23B illustrative embodiments of mobile display units in accordance with the present invention are shown. Free-standing display unit 208 includes a frame work of vertical and horizontal members (12 and 14, respectively) and panels 16 as shown in the display system of FIG. 1, as well as trim pieces 161 and 163 as shown attached to partition 160 of FIG. 13. In FIG. 23A, free-standing display unit 208 is supported by base 200, which may include wheels, or casters, 202 for improved mobility, or may be used without wheels 202 when a semi-permanent installation is desired. Alternatively, display 208 may be supported by casters 202 attached to legs 206 as shown in FIG. 23B. Also shown in FIG. 23B, cap 161 may have sockets similar to socket 25 of horizontal member 14 of FIG. 2 for attachment of small items, such as sign 207 and the like. Other furniture pieces such as shelves 18 and rack 20 can be attached to free-standing displays 208 and 210.

Preferably, free-standing display units 208 and 210 have a power supply hidden within base 200 or behind panels 16, so that free-standing display unit 208 and 210 may advantageously be moved to any convenient location with relative ease and may be energized by plugging power cord 204 into any nearby electrical outlet. Alternatively, display units 208 and 210 may include batteries or power cells and the like to permit the display units to be used, for limited periods of time, in areas removed from electrical outlets.

While a preferred embodiment of the present invention has been described herein, it will be apparent to one skilled in the art that various changes and modifications may be made therein with out departing from the spirit and scope of the invention. For example, combining structural elements, substituting materials, and interchanging prongs and sockets are exemplary modifications which would not fall outside the scope of the present invention. Therefore, it is intended that the appended claims cover all such changes and modifications which fall within the true spirit and scope of the invention.

We claim:

1. A modular furniture system comprising:

a first vertical member comprising:

a first outer member having a first opening in a face thereof; and a first conductive member disposed behind the first outer member such that a portion of the first conductive member is disposed near the first opening, the first conductive member being adapted to be coupled to a source of electrical power; and a first support member comprising a conductive material, the first support member including:

a shank portion for engaging the first opening; and a contact portion for making electrical contact with the first conductive member.

2. The modular furniture system of claim 1 further comprising:

a second vertical member, comprising:

a second outer member having a second opening in a face thereof; and a second conductive member disposed behind a second outer member such that a portion of the second conductive member is disposed near the second opening, the second conductive member being adapted to be coupled to the source of electrical power, wherein the first and second vertical members are juxtaposed in a spaced apart, substantially parallel relation, and wherein the second conductive member is adapted to be coupled to a source of electrical power.

3. The modular furniture system of claim 2 further comprising a power source coupled to the first and second conductive members such that they are of opposite polarity.

4. The modular furniture system of claim 3 wherein the power source is a low voltage power source.

5. The modular furniture system of claim 2 further comprising a horizontal member disposed between the first and second vertical members, the horizontal member comprising:

first and second ends adapted to couple to the first and second conductive members; and at least one electrical fixture coupled between the first and second ends, such that the at least one electrical fixture is electrically coupled to the first and second conductive members.

6. The modular furniture system of claim 2 further comprising a panel coupled between the first and second vertical members.

7. The modular furniture system of claim 6 wherein the panel includes at least one electrical fixture, the panel being electrically coupled to the first and second conductive members such that the electrical fixture receives power therefrom.

8. The modular furniture system of claim 7 wherein the panel has a translucent surface and the at least one electrical fixture is a light disposed behind the translucent surface.

9. The modular furniture system of claim 5 or 7 wherein the at least one electrical fixture comprises a socket.

10. The modular furniture system of claim 9 further comprising an electrical device including a plug for mating with the socket such that the electrical device receives electrical power via the socket.

11. The modular furniture system of claim 10 wherein the electrical device comprises a light.

12. The modular furniture system of claim 1 wherein the vertical member further comprises:

a second opening in the face of the first outer member, such that the second opening is substantially level with, but spaced apart from, the first opening; and a second conductive member disposed behind the face of the first outer member such that a portion of the second conductive member is disposed near the second opening, wherein the second conductive member is adapted to be coupled to a source of electrical power having a polarity opposite that of the first conductive member.

13. The modular furniture system of claim 2 or 12 further comprising a second support member comprising a conductive material, the second support member including:

a shank portion for engaging the second opening; and a contact portion for making electrical contact with the second conductive member.

14. The modular furniture system of claims 13 further comprising a furniture piece coupled between the first and second support members.

15. The modular furniture system of claim 14 wherein the furniture piece comprises a shelf, desk, clothes rod, or display case.

16. The modular furniture system of claim 14 wherein the furniture piece comprises a light, the light being electrically coupled to the first and second support members.

17. The modular furniture system of claim 16 wherein the light is disposed on the underside of a shelf, or inside a desk.

* * * * *